US006400350B1

(12) United States Patent
Nishimura et al.

(10) Patent No.: US 6,400,350 B1
(45) **Date of Patent: *Jun. 4, 2002**

(54) METHOD FOR DRIVING LIQUID CRYSTAL DISPLAY APPARATUS

(75) Inventors: Masaru Nishimura; Yasuhiko Kohno, both of Tokyo (JP)

(73) Assignee: Mitsubishi Denki Kabushiki Kaisha, Tokyo (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/128,762

(22) Filed: Aug. 4, 1998

(30) Foreign Application Priority Data

Nov. 13, 1997 (JP) ..... 9-311854

(51) Int. Cl.[7] ..... G09G 3/36; G09G 5/00
(52) U.S. Cl. ..... 345/96; 345/209
(58) Field of Search ..... 345/96, 209, 152, 345/153, 79, 694–696

(56) References Cited

U.S. PATENT DOCUMENTS 5,654,733 A * 8/1997 Chimura ..... 345/96
5,790,092 A * 8/1998 Moriyama ..... 345/209
5,847,687 A * 12/1998 Hirakata ..... 345/96

FOREIGN PATENT DOCUMENTS

| | | |
|---|---|---|
| JP | 60-151615 | 8/1985 |
| JP | 4-275521 | 10/1992 |
| JP | 5-61440 | 3/1993 |
| JP | 5-127618 | 5/1993 |
| JP | 8-122743 | 5/1996 |
| JP | 8-292419 | 11/1996 |

* cited by examiner

*Primary Examiner*—Richard Hjerpe
*Assistant Examiner*—Duc Q Dinh
(74) *Attorney, Agent, or Firm*—Oblon, Spivak, McClelland, Maier & Neustadt, P.C.

(57) ABSTRACT

A method is provided for driving an LCD apparatus in which a predetermined image is displayed by applying predetermined column signals to pixels constituting selected rows of an array of pixels arranged in columns and rows. The pixels are divided to form pluralities of groups that each have at least two pixels in either a column direction or a row direction. The column signals associated with each group are provided with a different polarity as to each adjacent group and a group characteristic is changed in different image frames. Alternatively, plural pixels in a column direction can be classified into a plurality of sets with each set including plural frames, and the polarity of the column signals for each of the sets can be changed or groups of pixels can be formed by dividing the pixels in the columns into groups all of which have at least two adjacent pixels in a direction of the columns and further with at least some of the groups having more than two pixels in the column direction and then applying column signals to each adjacent group in the column direction with a different polarity.

7 Claims, 21 Drawing Sheets

METHOD FOR DRIVING LIQUID CRYSTAL DISPLAY APPARATUS

BACKGROUND OF THE INVENTION

The present invention relates to a method for driving a matrix type LCD (liquid crystal displaying) apparatus composed of a plurality of pixels arranged in rows and columns.

Generally the matrix type LCD apparatus is composed of a plurality of pixels. The plurality of pixels are arranged in rows and columns with a plurality of first lines arranged parallel to each other and a plurality of second lines perpendicular to the first lines provided as boundary lines. Thin film transistors (hereinafter referred to as TFTs) are provided as active elements in the crossing portions between the first lines and the second lines. The pixels include liquid crystals.

One example of a method of driving the conventional LCD apparatus will be described.

FIGS. 20(*a*) and 20(*b*) are illustrating diagrams each showing one example of the conventional LCD apparatus. FIG. 20(*a*) shows polarities of the column signals (or the image signals) to be applied to pixels of the LCD apparatus in a certain frame (for example, m frame, where m is 0 (zero) or natural number). FIG. 20(*b*) shows polarities of column signals to be applied to pixels of the LCD apparatus in (m+1) frame. In FIGS. 20(*a*) and 20(*b*), reference numeral 1 denotes a signal driving circuit for generating column signals to be applied to pixels, reference numeral 2 denotes a row driving circuit for generating row signals (or line signals) for selecting the rows, reference numeral 3 shows first lines, lines (hereinafter referred to as "column signal line") connected with the signal driving circuit 1 for generating the column signals, reference numeral 4 denotes second lines, lines (hereinafter referred to as "row signal line") connected with the row driving circuit 2 for generating the row signals, reference numeral 5 shows pixels. A "+" or "−" shown to the pixels indicates a polarity, that is, positive or negative, as a model, of the column signal to be applied upon the pixel.

In FIGS. 20(*a*) and 20(*b*), number of the column signal lines 3 is 14, number of the row signal lines 4 is 12, and number of the pixels is 168, but the respective number of the column signal lines 3, the row signal lines 4 and the pixels is not restricted to the above description. TFTs are provided in the crossing portions between the column signal lines 3 and the row signal lines 4, and the TFTs are connected with the column signal lines 3 and the row signal lines 4, which are not shown in FIGS. 20(*a*) and 20(*b*). When a row signal having a voltage value, which turns on the TFT only in the particular row signal line, of a plurality of row signal lines 4, is applied (namely, a specific row signal line is selected), the TFT connected with the specific row signal line is turned on, and the remaining TFTs are turned off. A column signal generated by a signal driving circuit is applied to only pixels including the turned on TFT.

In order to display a given image, the LCD apparatus carries out operations of, (1) giving to column signal lines 3 a plurality of column signals outputted from the signal driving circuit 1, (2) selecting a specific row signal line 4 by a row signal outputted from the row driving circuit 2, (3) turning on only a TFT connected with the selected row signal line 4, (4) applying a given column signal generated by the column driving circuit to each pixel including the turned on TFT, and (5) controlling a transmission factor of the liquid crystal light of each pixel by the potential difference between the applied predetermined column signal and the opposite common signal. The column signal and the opposite signal are applied to two electrodes (not shown) which give an electric field to the liquid crystal.

When the voltage of the same polarity is generally applied to the liquid crystal for long hours, the liquid crystal is often deteriorated. In case the voltage stops applying to the liquid crystal, the transmission factor of the liquid crystal light may be returned to the light transmission factor before the voltage is applied to the liquid crystal. Thus, it is necessary to alternate the column signal by often changing the polarity of the column signal to be applied. In the conventional LCD apparatus shown in FIGS. 20(*a*) and (*b*), the polarity of the column signal to be applied to each pixel is changed for each frame to drive the LCD apparatus. A method of driving the LCD apparatus by changing the polarity of the column signal for each frame is a frame inversion driving method. When the frame inversion driving method is used, a period where the polarity of the column signal changes becomes a low frequency. In the actual displaying operation, flickers (in image) on the display are conspicuous. Since the column signal is the same in polarity as the row signal in one frame, cross talk becomes larger by receiving the influences of the column signal and the row signal to be applied on the other pixels, thereby deteriorating the picture quality.

A method of driving the conventional LCD apparatus provided for solving the above described problems.

FIG. 21 is illustrating diagram showing the other examples of the conventional LCD apparatus. In FIG. 21, the same reference numerals are used about the same locations as those of FIGS. 20(*a*) and 20(*b*). In the LCD apparatus shown in FIG. 21, the polarity of the column signal is changed for each pixel to drive the LCD apparatus. A method of changing the plurality of the column signal for each pixel to drive the LCD apparatus is referred to as dot inversion driving method. When the dot inversion driving method is used, flickers and cross talk which are caused by using the frame inversion driving method are reduced. A period where the plurality of the column signal becomes an extra-high frequency to increase the power consumption in driving the LCD apparatus. The number of the pixels increases due to recent higher resolution, and time for applying the column signal upon pixels becomes shorter, thereby causing faulty charging to lower the picture quality.

When the frame inversion driving method is used, flickers and cross talk are caused to lower the picture quality. When the dot inversion driving method is used, power consumption in driving the LCD apparatus increases. In the LCD apparatus of high resolution, inferior charging is caused to lower the picture quality. Thus, it is hard to make the high picture quality and the lower power consumption compatible.

SUMMARY OF THE INVENTION

Accordingly, an object of the present invention is to provide a method of driving a LCD apparatus of realizing the high picture quality by reducing the flickers, and of lower power consumption.

A method of driving an LCD apparatus according to the present invention is to display the predetermined images by applying the predetermined column signals upon the pixels for constituting the selected rows, of a plurality of pixels arranged in rows and columns, where a plurality of pixels are divided into a plurality of groups each composed of at least two pixels in the column direction, so as to change the polarity of the column signal for each group.

In the present specification, the column direction is referred to as a direction parallel to the column signal line.

A method of driving the LCD apparatus according to the present invention is to change for each frame the pixels constituting each group.

In a method of driving the LCD apparatus according to the present invention, one group is composed of n pixels and the boundary portion between the groups is shifted by (n−1) pixels for each frame.

A method of driving the LCD apparatus according to the present invention is to change for each group the number of the pixels for constituting one group.

A method of driving the LCD apparatus according to the present invention is to change regularly the number of the pixels for constituting the one group.

A method of driving the LCD apparatus according to the present invention is to change irregularly the number of the pixels for constituting the one group.

A method of driving the LCD apparatus according to the present invention is to restrict the number of the pixels for constituting the one group.

A method of driving the LCD apparatus according to the present invention is to have at least two in number of rows for selecting at the same time.

A method of driving the LCD apparatus according to the present invention is not to apply a row signal for controlling a selecting row upon the row, when the polarity of the vertical clock signal changes, in case the same row is selected before and after the raise and fall edge of signal which becomes a control reference of the vertical clock signal for controlling the timing for changing the column signal.

A method of driving the LCD apparatus according to the present invention is to have the same polarity of the pixel for constituting a row for selecting at the same time in the column direction.

A method of driving the LCD apparatus according to the present invention is to have the same polarity, in the column direction, of the pixel for constituting a row selected at the same time with the number of the rows to be selected at the same time being at least one.

A method of driving the LCD apparatus according to the present invention is to display the predetermined images by applying the predetermined column signals upon the pixels for constituting the selected row, of a plurality of pixels arranged in rows and columns, where a plurality of pixels each being divided into a plurality of groups each composed of at least two pixels in the row direction, so as to change the polarity of the column signal for each group.

In the present specification, the row direction is referred to as a direction parallel to the row signal line.

A method of driving the LCD apparatus the present invention is to display the predetermined images by applying the predetermined column signals upon the pixels for constituting the selected row, of a plurality of pixels arranged in rows and columns, where a plurality of pixels are divided into a plurality of groups each composed of at least two pixels in the row direction and the column direction, so as to change the polarity of the column signal for each group.

The method of driving the LCD apparatus according to the present invention is to display the predetermined images by applying the predetermined column signal upon the pixel for constituting the selected row, of a plurality of pixels arranged in rows and columns, where a plurality of frames are set collectively to classify plural pixels into a plurality of sets in the row direction, so as to change the polarity of the column signal for each set.

A method of driving the LCD apparatus of the present invention is to have at least two in number of rows for selecting at the same time.

In a method of driving the LCD apparatus of the present invention, a row signal for controlling a selecting row upon the row is not applied, when the polarity of the vertical clock signal changes, in case the same row is selected before and after the raise and fall edge of signal which becomes a control reference of the vertical clock signal for controlling the timing for changing the column signal.

A method of driving the LCD apparatus of the present invention is to have the same polarity of the pixel for composing a row for selecting at the same time in the column direction.

A method of driving the LCD apparatus according to the present invention is to have the same polarity, in the column direction, of the pixel for constituting a row selected at the same time with the number of the rows to be selected at the same time being at least one.

A method of driving the LCD apparatus according to the present invention is to change regularly the number of the frames for constituting the set.

A method of driving the LCD apparatus described in the present invention is to change irregularly the number of the frames for constituting the set.

A method of driving the LCD apparatus of the present invention is to display the predetermined images by applying the predetermined column signal upon the pixel for composing the selected row, of a plurality of pixels arranged in rows and columns, where a plurality of frames are set collectively to classify plural pixels into a plurality of sets in the row direction, so as to change the polarity of the column signal for each set.

A method of driving the LCD apparatus of the present invention is to have at least two in number of rows for selecting at the same time.

In a method of driving the LCD apparatus of the present invention, a row signal for controlling a selecting row upon the row is not applied, when the polarity of the vertical clock signal changes, in case the same row is selected before and after the raise and fall edge of signal which becomes a control reference of the vertical clock signal for controlling the timing for changing the column signal.

A method of driving the LCD apparatus of the present invention is to have the same polarity of the pixel for constituting a row for selecting at the same time in the column direction.

A method of driving the LCD apparatus described of the present invention is to have the same polarity, in the column direction, of the pixel for constituting a row selected at the same time with the number of the rows to be selected at the same time being at least one.

A method of driving the LCD apparatus of the present invention is to change regularly the number of the frames for constituting the set.

A method of driving the LCD apparatus of the present invention is to change irregularly the number of the frames for constituting the set.

DETAILED DESCRIPTION

Figure 1A:
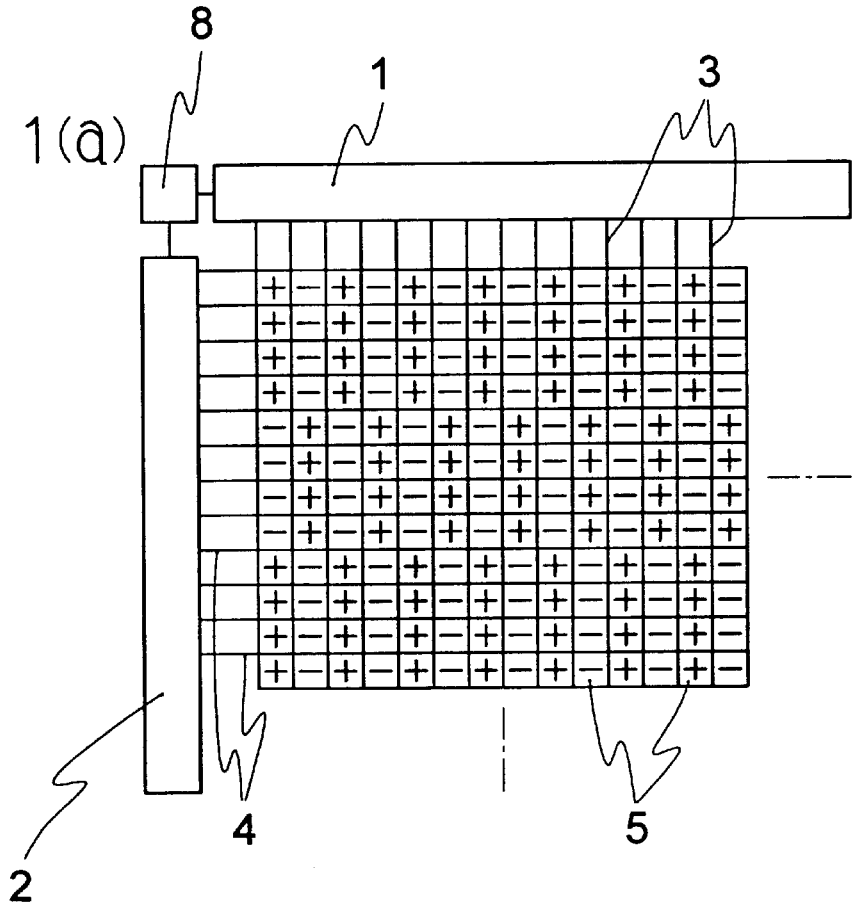
FIGS. 1(*a*) and 1(*b*) are explanatory drawings for illustrating an example of LCD apparatus and Embodiment 1 of the driving method of LCD apparatus of the present invention.

Embodiments of a method of driving the LCD apparatus of the present invention will be described.

EMBODIMENT 1

Referring to the drawings, Embodiment 1 of the method of driving the LCD apparatus of the present invention will be described. In the present embodiment, a plurality of pixels are divided into a plurality of groups each comprising at least two pixels, so as to change the polarity of the column signal for each group. In this specification, the polarity of the column signal is referred to as the polarity of the voltage value of the column signal with respect to the voltage value of the opposite common signal.

Figure 1B:
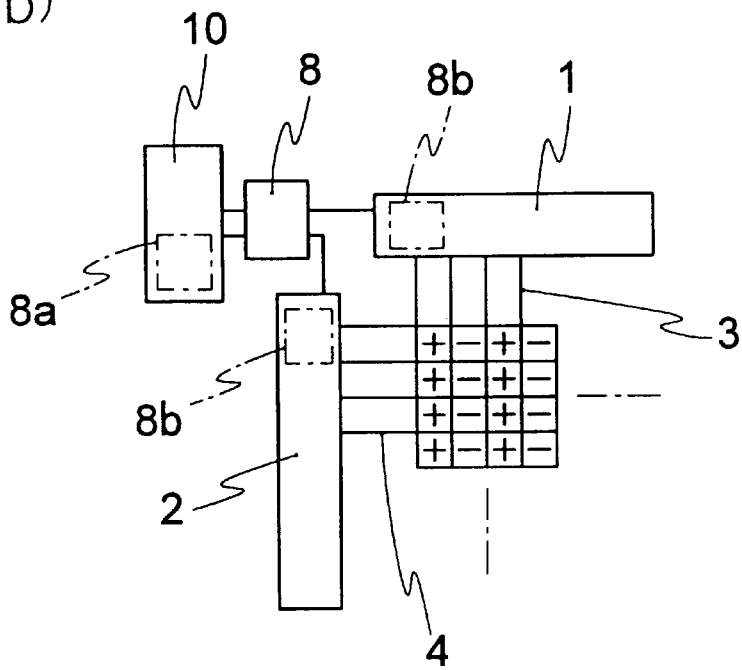
Figure 20A:
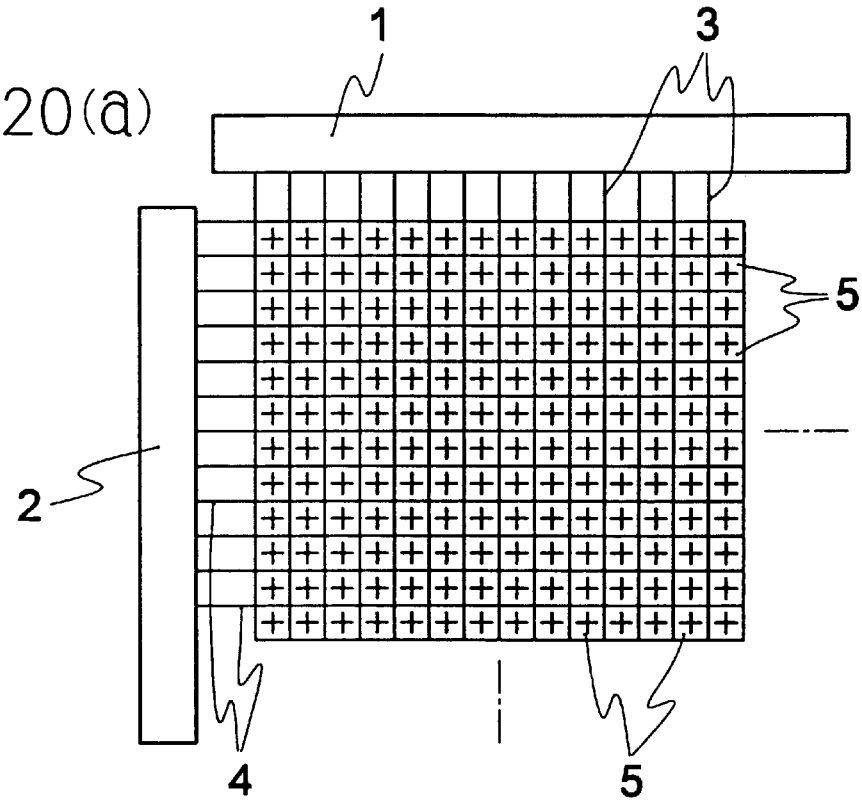
FIGS. 20(*a*) and 20(*b*) are explanatory drawings showing an example of the conventional LCD apparatus.
Figure 20B:
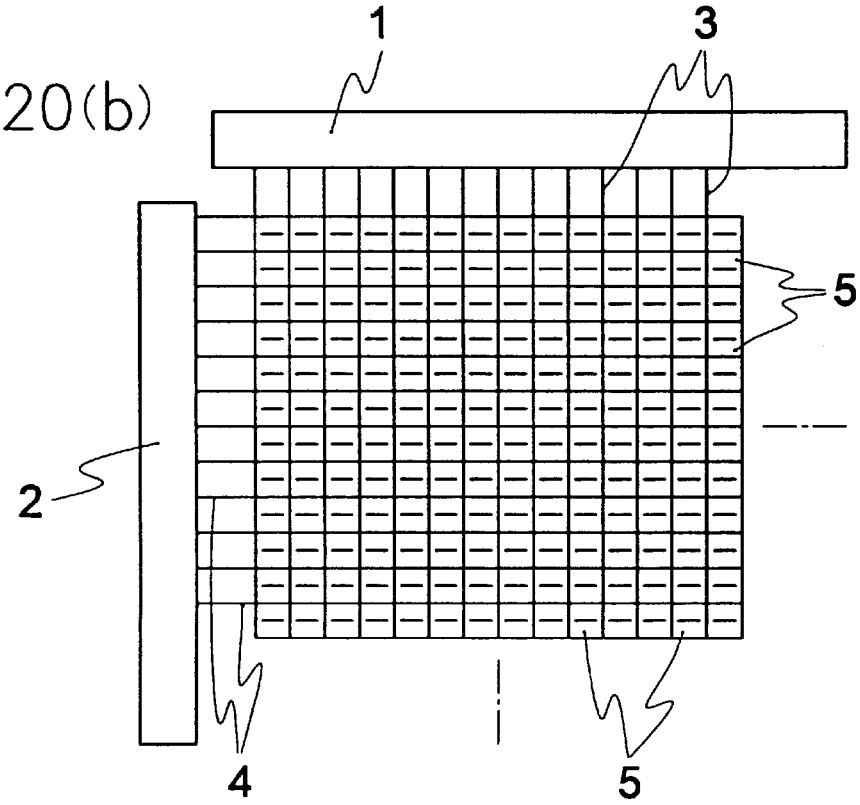
Figure 21:
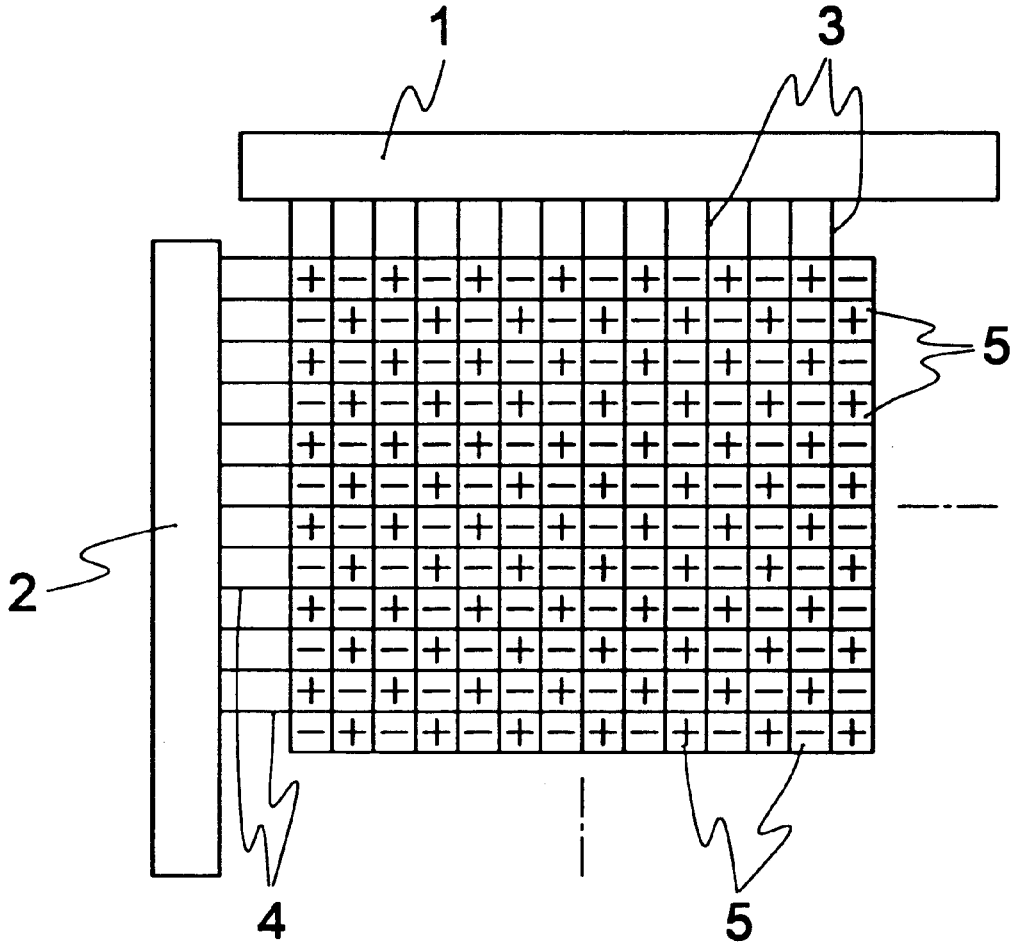
FIG. 21 is an explanatory drawing showing another example of the conventional LCD apparatus.

FIGS. 1(*a*) and 1(*b*) are illustrating views showing one example of the LCD apparatus. FIGS. 1(*a*) and 1(*b*) are shown to illustrate Embodiment 1 of the method of driving the LCD apparatus of the present invention. In FIG. 1(*a*), reference numeral 8 denotes a polarity control signal generating circuit for generating a control signal for changing polarity of column signals; further in FIG. 1(*b*), reference numeral 10 denotes a control circuit; and reference numerals 8*a* and 8*b* denote areas for providing the polarity control signal generating circuit therein. The same reference numerals are used for the same locations as those of FIGS. 20(*a*) and 20(*b*), and denote the same as the conventional LCD apparatus. In the LCD apparatus of FIGS. 1(*a*) and 1(*b*), one group is composed of four pixels in the column direction.

For example, in twelve pixels provided on the leftmost side of the paper face, the polarities of the column signal to be applied upon the first through fourth and the ninth through twelfth pixels from the top in the column direction are positive, and the polarities of the column signal to be applied upon the fifth through eighth pixels are negative. In the fourteenth pixels provided upon the topmost side of the paper face, the polarity of the column signal in the row direction changes for each of pixels, and the column signal to be applied upon the leftmost pixel is positive.

According to the method of driving the LCD apparatus of Embodiment 1, a period where the polarity of the column signal changes as compared with the frame inversion driving method becomes a high frequency so that high picture quality display where flickers and cross talk are reduced can be realized. A period where the polarity of the column signal changes as compared with the dot inversion driving method becomes a low frequency so that the power consumption in driving the LCD apparatus can be lowered.

Controlling the polarity change of the column signal can be realized by adding the controlling circuit to the signal driving circuit 1 and the row driving circuit 2. For example, in order to change the polarity of pixels for constituting one group, the polarity control signal generating circuit 8 is provided additionally to the signal driving circuit. As shown in FIG. 1(*b*), the polarity control signal generating circuit can also be provided in the area 8*a* in the control circuit 10 for controlling signal driving circuit 1 and row driving circuit 2 and can also be provided independently as shown in FIG. 1(*a*), and further can also be provided in both areas 8*b* in the signal driving circuit 1 and the row driving circuit 2. In the following explanation, the polarity control signal generating circuit is shown as an example in which the polarity control signal generating circuit is provided independently as shown in FIG. 1(*a*). The polarity control signal generating circuit 8 is composed of combination of logic circuits such as gate array, thus controlling output timing of column signals such that every plural pixels constitute one group. As a result, the polarity change and the output timing of the column signals relating to each pixel can be controlled for every optional plural pixels. Further, a timing controller for adjusting polarity of column signal or row signal is provided in the signal driving circuit 1 and in row driving circuit 2. The controlling the polarity change can be realized also by adding a function for controlling the polarity change of the column signal to the timing controller, for example by adding logic circuits to the timing controller.

In the present embodiment are four pixels in number for constituting one group, which is not restricted to it. One group has only to be composed of two pixels or more.

EMBODIMENT 2

Embodiment 2 of the method of driving the LCD of the present invention will be described with reference to the drawings. This embodiment is directed to change for each frame the pixel for constiuting one group in addition to a method of driving the LCD apparatus shown in Embodiment 1.

In this case too, logic circuit are combined in polarity control signal generating circuit 8 similarly to Embodiment 1 and then polarity change and output timing of the column signals relating to each pixel is controlled optionally; and polarity change of column signal is controlled thereby.

Figure 2A:
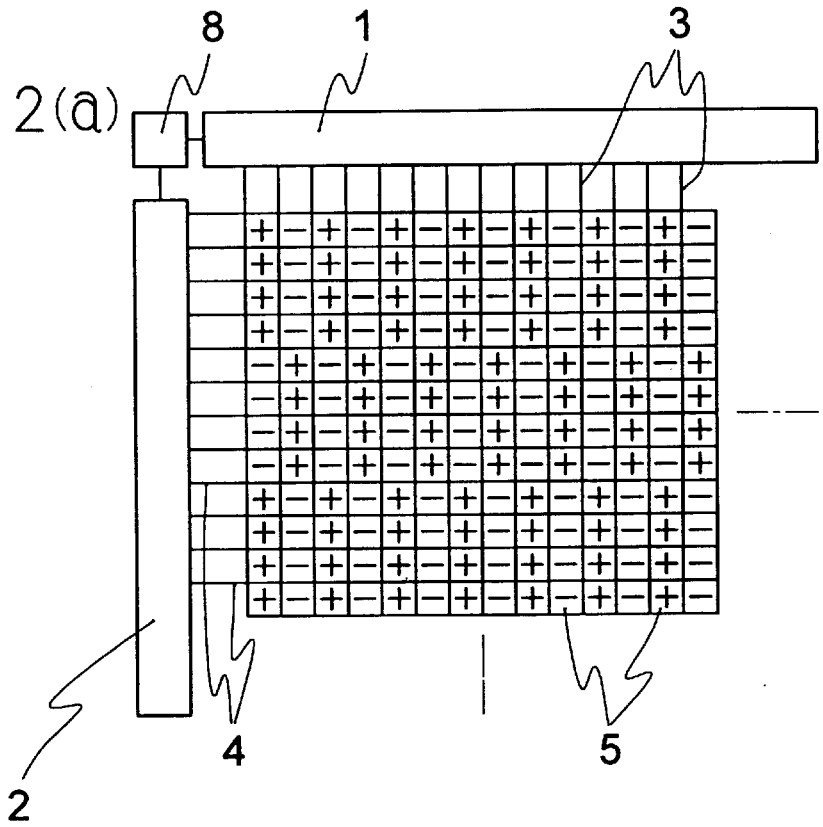
FIGS. 2(*a*) and 2(*b*) are explanatory drawings for illustrating other example of LCD apparatus and Embodiment 2 of the driving method of LCD apparatus of the present invention.
Figure 2B:
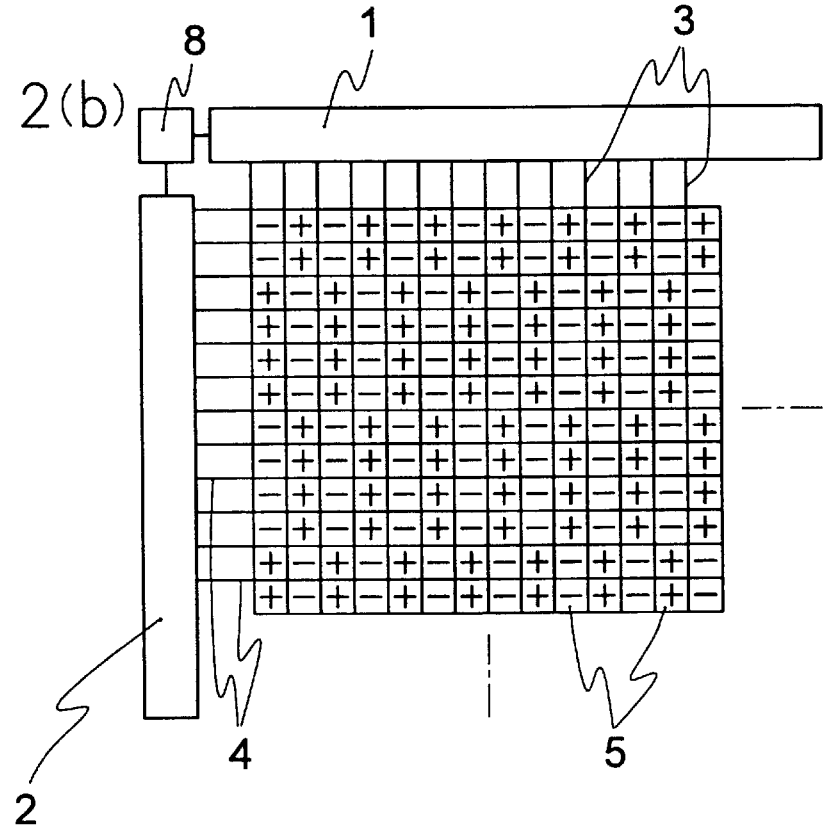

FIGS. 2(*a*) and 2(*b*) indicate illustrating diagrams showing another embodiment of the LCD apparatus.

FIGS. 2(*a*) and 2(*b*) are shown to illustrate Embodiment 2 of the method of driving the LCD apparatus of the present invention. FIG. 2(*a*) shows the polarity of the column signal to be applied to each pixel of the LCD apparatus in the m frame. FIG. 2(*b*) shows the polarity of the column signal to be applied to each pixel of the LCD apparatus in the (m+1) frame. The LCD apparatus shown in FIGS. 2(*a*) and 2(*b*) is the same as the LCD apparatus of Embodiment 1, where the same reference numerals are used for the same locations as those of FIGS. 1(*a*) and 1(*b*).

As shown in FIG. 2(*a*), in the m frame, one group is composed of four pixels in a column direction. Namely, in twelve pixels provided in the leftmost side of the paper face, the polarities of the column signals to be applied to first through fourth and the ninth through twelfth pixels from the top in the column direction are positive, and the polarities of the column signals to be applied to the fifth through eighth pixels are negative. As shown in FIG. 2(*b*), in the (m+1) frame, twelve pixels provided on the leftmost side of the paper face are negative in polarities of the column signals to be applied to the first, second and seventh through tenth pixels from the top in the column direction, and the polarities of the column signals to be applied to the third through sixth, eleventh and twelfth pixels are positive.

According to the method of driving the LCD apparatus of Embodiment 2, a period where the polarity of the column signal changes as compared with the frame inversion driving method becomes a high frequency so that high picture quality display where flickers and cross talk are reduced can be realized to prevent the liquid crystal from being deteriorated. A period where the polarity of the column signal changes as compared with the dot inversion driving method becomes a low frequency so that the power consumption in driving the LCD apparatus can be lowered.

EMBODIMENT 3

Embodiment 3 of the method of driving the LCD apparatus of the present invention will be described with reference to the drawings. In addition to the method of driving the LCD apparatus shown in Embodiment 1, the present embodiment has one group composed of n pixels with the boundary portion between groups for each frame being shifted by (n−1) pixels (n is 0 or natural number).

Figure 3A:
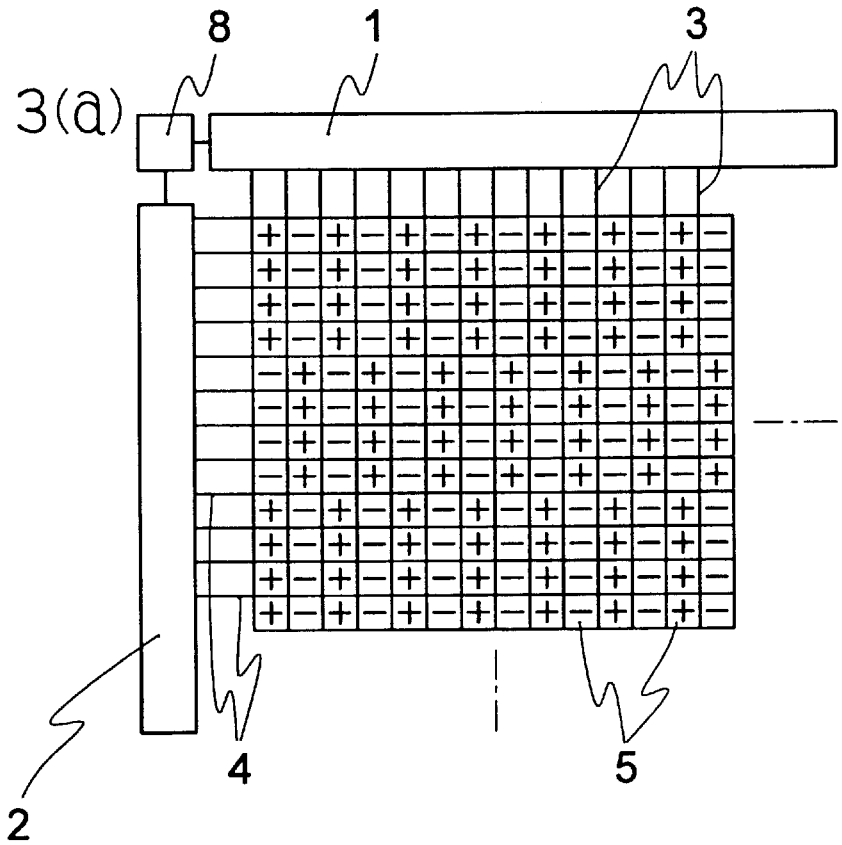
FIGS. 3(*a*) and 3(*b*) are explanatory drawings for illustrating other example of LCD apparatus and Embodiment 3 of the driving method of LCD apparatus of the present invention.
Figure 3B:
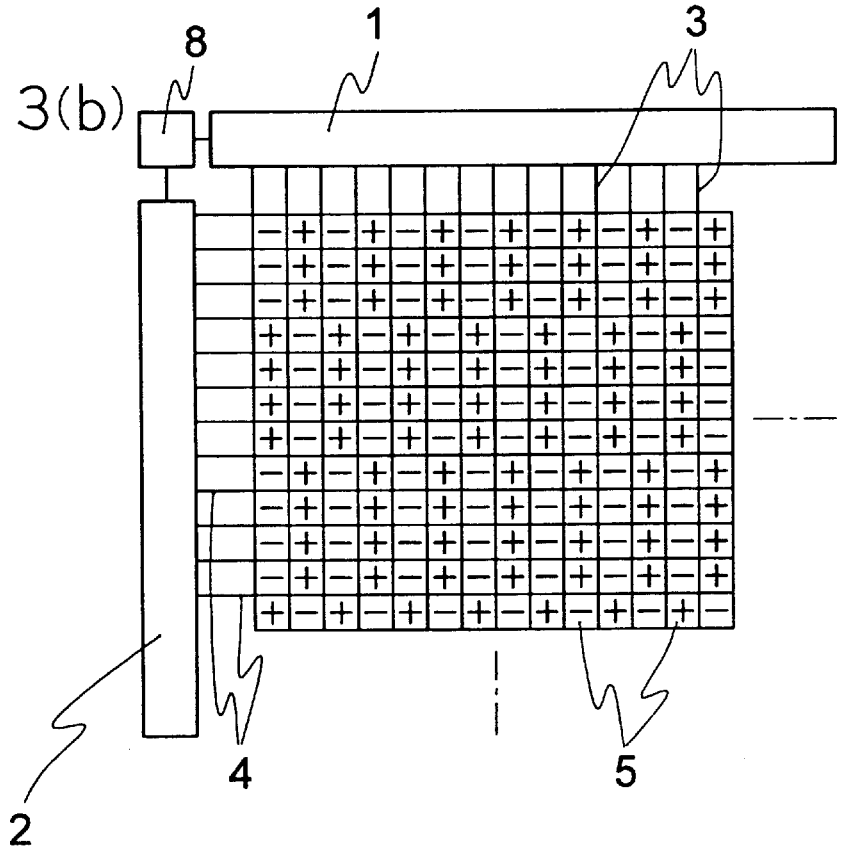

FIGS. 3(*a*) and 3(*b*) indicate illustrating diagrams showing another example of the LCD apparatus. FIGS. 3(*a*) and 3(*b*) illustrate Embodiment 3 of the method of driving the LCD apparatus of the present invention. FIG. 3(*a*) shows the polarity of the column signal to be applied to each pixel of the LCD apparatus in the m frame. FIG. 3(*b*) shows the polarity of the column signals to be applied to each pixel of the LCD apparatus in the (m+1) frame. The LCD apparatus shown in FIGS. 3(*a*) and 3(*b*) is the same as the LCD apparatus in Embodiment 1, where the same reference numerals are used for the same locations as those of FIGS. 1(*a*) and 1(*b*).

As shown in FIG. 3(*a*), in the m frame, one group is composed of four pixels in the column direction. As shown in FIG. 3(*b*), the boundary portions between groups are shifted downwards by three pixels. Namely, in twelve pixels provided on the leftmost side of the paper face, the polarities of the column signals to be applied upon the first through third and the eighth through eleventh pixels from the top in the column direction are negative, and the polarities of the column signals to be applied upon the fourth through seventh and twelfth pixels are positive. The polarities of the column signals to be applied to the thirteenth through fifteenth pixels (not shown) are the same as those of the column signals to be applied to the twelfth pixel. In this case too, logic circuits are combined in polarity control signal generating circuit 8 similarly to Embodiment 1 and then polarity change and output timing of the column signals relating to each pixel is controlled optionally; and polarity change of column signal is controlled thereby.

According to the method of driving the LCD apparatus of Embodiment 3, boundary lines between the groups, that is, positions where the polarities of the column signals change within one frame change for each frame. Accordingly, the flickers can be reduced in number, and the display of the high picture quality where the cross talk is reduced can be realized with low power consumption.

In the present embodiment, the shifting grade is not restricted to three pixels although the boundary portion between the groups for each frame is shifted by three pixels.

EMBODIMENT 4

Embodiment 4 of the method of driving the LCD apparatus of the present invention will be described with reference to the drawings. In addition to the method of driving the LCD apparatus shown in Embodiment 1, this embodiment changes for each group the number of the pixels for constituting one group in one frame.

Figure 4:
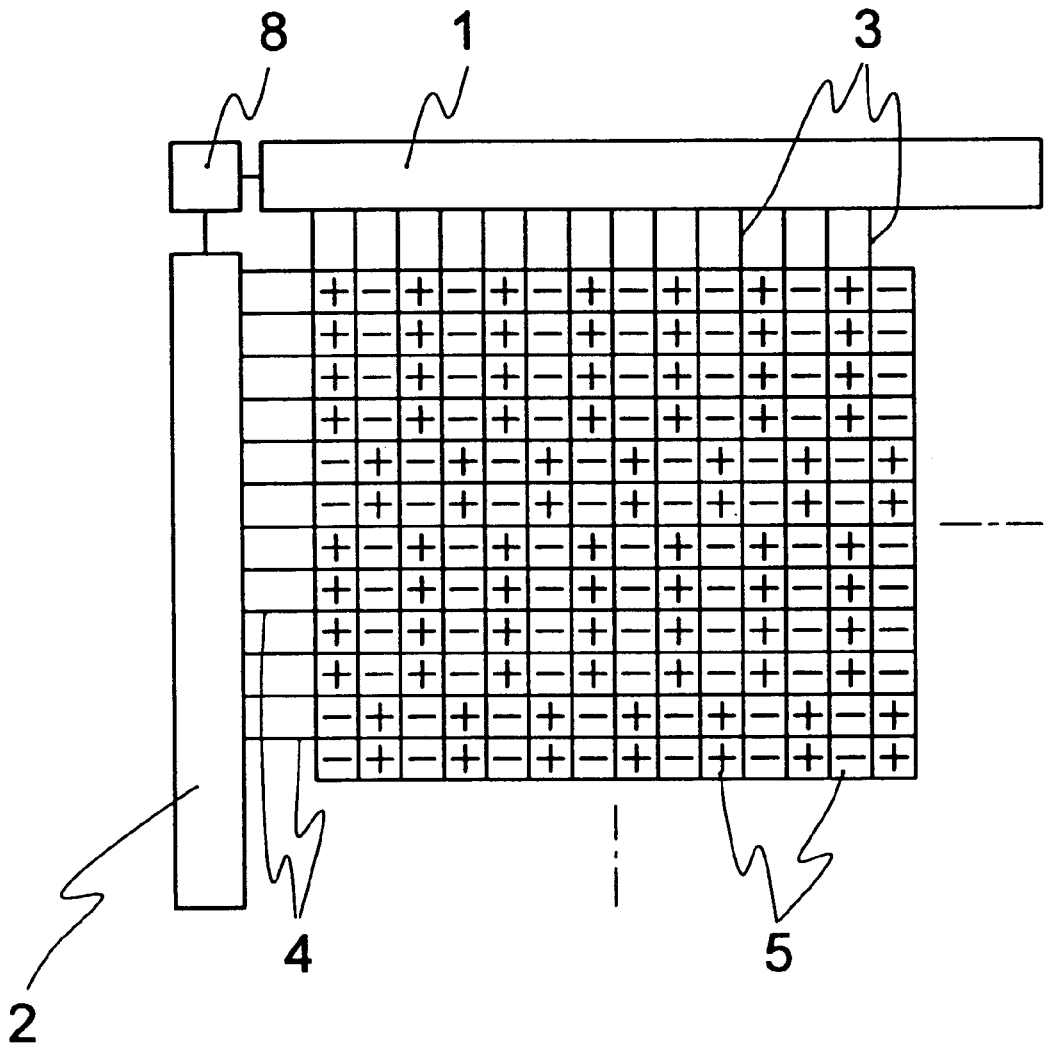
FIG. 4 is an explanatory drawing for illustrating other example of LCD apparatus and Embodiment 4 of the driving method of LCD apparatus of the present invention.

FIG. 4 is an illustrating diagram showing another example of the LCD apparatus. FIG. 4 is shown to illustrate Embodiment 4 of the method of driving the LCD apparatus of the present invention. The same reference numerals are used for the same locations as those of FIG. 1, because the LCD apparatus shown in FIG. 4 is the same as the LCD apparatus of Embodiment 1. As shown in FIG. 4, twelve pixels provided on the leftmost side of the paper face regularly change by four pixels, two pixels, four pixels and two pixels from the top in the column direction, the number of the pixels for constituting one group.

For example, in twelve pixels provided on the leftmost side of the paper face, the polarities of the column signals to be applied upon the first through fourth and the seventh through tenth pixels from the top in the column direction are positive, and the polarities of the column signals to be applied upon the fifth, sixth, eleventh and twelfth pixels are negative. In order to change the number of the pixels for constituting one group regularly, polarity change and output timing of the column signals relating to each pixel is controlled optionally; and polarity change of column signal is controlled thereby.

According to method of driving the LCD apparatus of Embodiment 4, a period where the polarity of the column signal changes is dispersed, the flickers can be further reduced in number, and the display of the high picture quality where the cross talk is less can be realized with lower power consumption.

EMBODIMENT 5

Embodiment 5 of the method of driving the LCD apparatus of the present invention will be described with reference to the drawings. In addition to the method of driving the LCD apparatus shown in Embodiment 1, the present embodiment changes at random for each group the number of the pixels for constituting one group in one frame.

Figure 5:
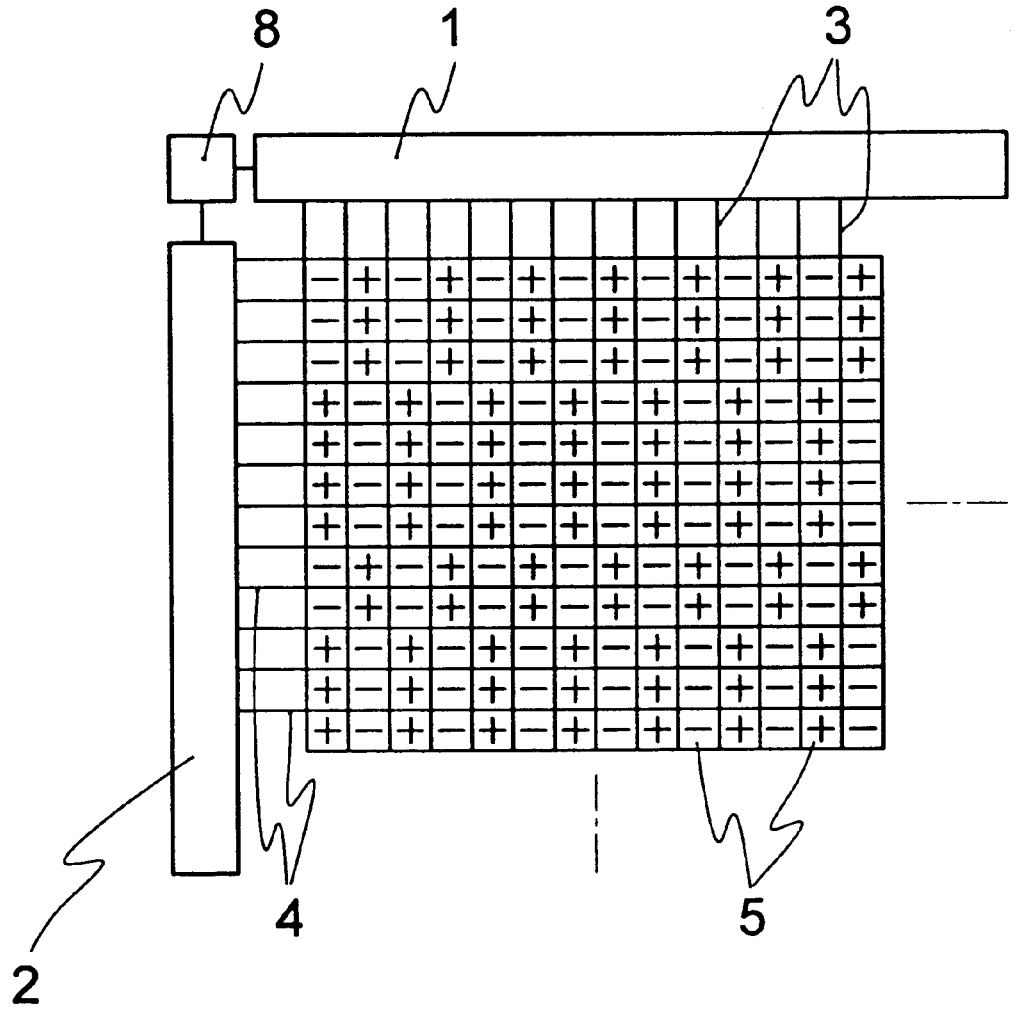
FIG. 5 is an explanatory drawing for illustrating other example of LCD apparatus and Embodiment 5 of the driving method of LCD apparatus of the present invention.

FIG. 5 is an illustrating diagram showing another example of the LCD apparatus. FIG. 5 is shown to illustrate Embodiment 5 of the method of driving the LCD apparatus of the present invention. The same reference numerals are used for the same locations as those of FIGS. 1(*a*) and 1(*b*), because the LCD apparatus shown in FIG. 5 is the same as the LCD apparatus of Embodiment 1. As shown in FIG. 5, twelve pixels provided on the leftmost side of the paper face irregularly change by three pixels, four pixels, two pixels and three pixels from the top in the column direction, the number of the pixels for constituting one group.

For example, in twelve pixels provided on the leftmost side of the paper face, the polarities of the column signals to be applied upon the first through third and the eighth and the ninth pixels from the top in the column direction are negative, and the polarities of the column signals to be applied upon the fourth through seventh the tenth through twelfth pixels are positive. In order to change the number of the pixels for constituting one group irregularly, polarity change and output timing of the column signals relating to each pixel is controlled irregularly; and polarity change of column signal is controlled thereby.

According to method of driving the LCD apparatus of Embodiment 5, a period where the polarity of the column signal changes is dispersed at random, the flickers can be reduced in number, and the display of the high picture quality where the cross talk is reduced can be realized with lower power consumption.

EMBODIMENT 6

Embodiment 6 of the method of driving the LCD apparatus of the present invention will be described with reference to the drawings. In addition to the method of driving the LCD apparatus shown in Embodiments 1, 2, 3, 4 or 5, the present embodiment is restricted in the number of pixels for constituting one group.

Figure 6:
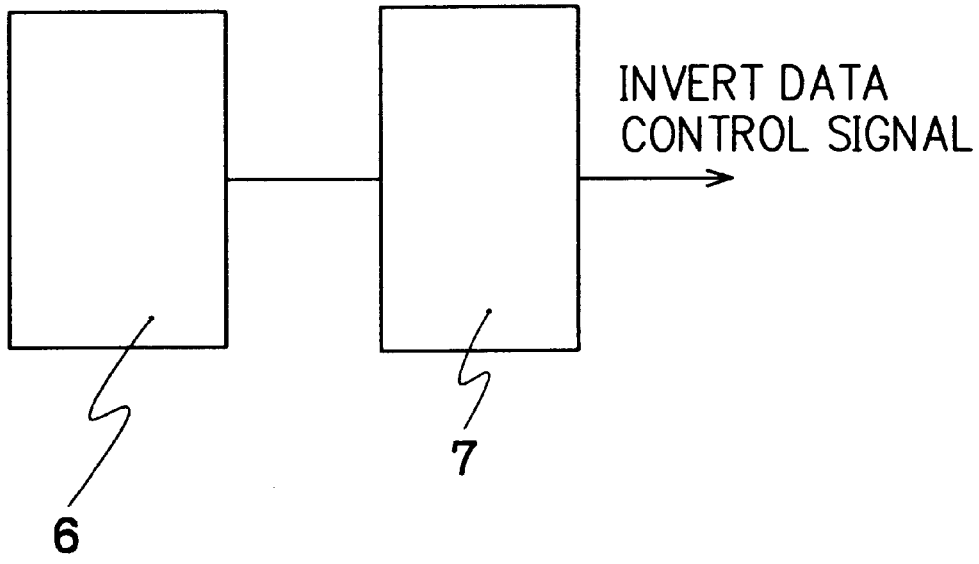
FIG. 6 is an explanatory drawing for illustrating other example of LCD apparatus and Embodiment 6 of the driving method of LCD apparatus of the present invention.

FIG. 6 is a block diagram showing one example of the control signal generating circuit to be used for realizing the method of driving the LCD apparatus of the present invention. Referring to FIG. 6, reference numeral 6 denotes a random pattern generating circuit, and reference numeral 7 denotes a modulating circuit.

As one example of the method of restricting the number of the pixels for constituting one group, a control signal (hereinafter referred to as "random pattern signal") to be used for changing at random for each group the number of the pixels for constituting one group can be easily realized through modulation by using MFM (Modified Frequency Modulation) or 2–7 RLL (Run Length Limited) modulation.

The random pattern generating circuit 6 is a circuit for generating a random pattern signal. MFM and 2–7 RLL are popular modulating method, and are used for magnetic disk or the like. A signal (hereinafter referred to as "invert data control signal") to be used for controlling the polarity of the column signal is outputted from the modulating circuit 7.

According to method of driving the LCD apparatus of Embodiment 6, a period where the polarity of the column signal changes is dispersed, the flickers can be considerably reduced in number, and the display of the high picture quality where the cross talk is reduced can be realized with lower power consumption. Since the number of the pixels for constituting one group can be restricted, the column signal of the same polarity can be prevented from being applied for long hours, the flickers can be further reduced and the liquid crystal can be prevented from being deteriorated.

EMBODIMENT 7

Embodiment 7 of the LCD apparatus of the present invention will be described with reference to the drawings. In addition to the method of driving the LCD apparatus to be shown in Embodiments 1, 2, 3, 4, 5 and 6, the present embodiment has at least two in the number of the rows to be selected at the same time.

Figure 7:
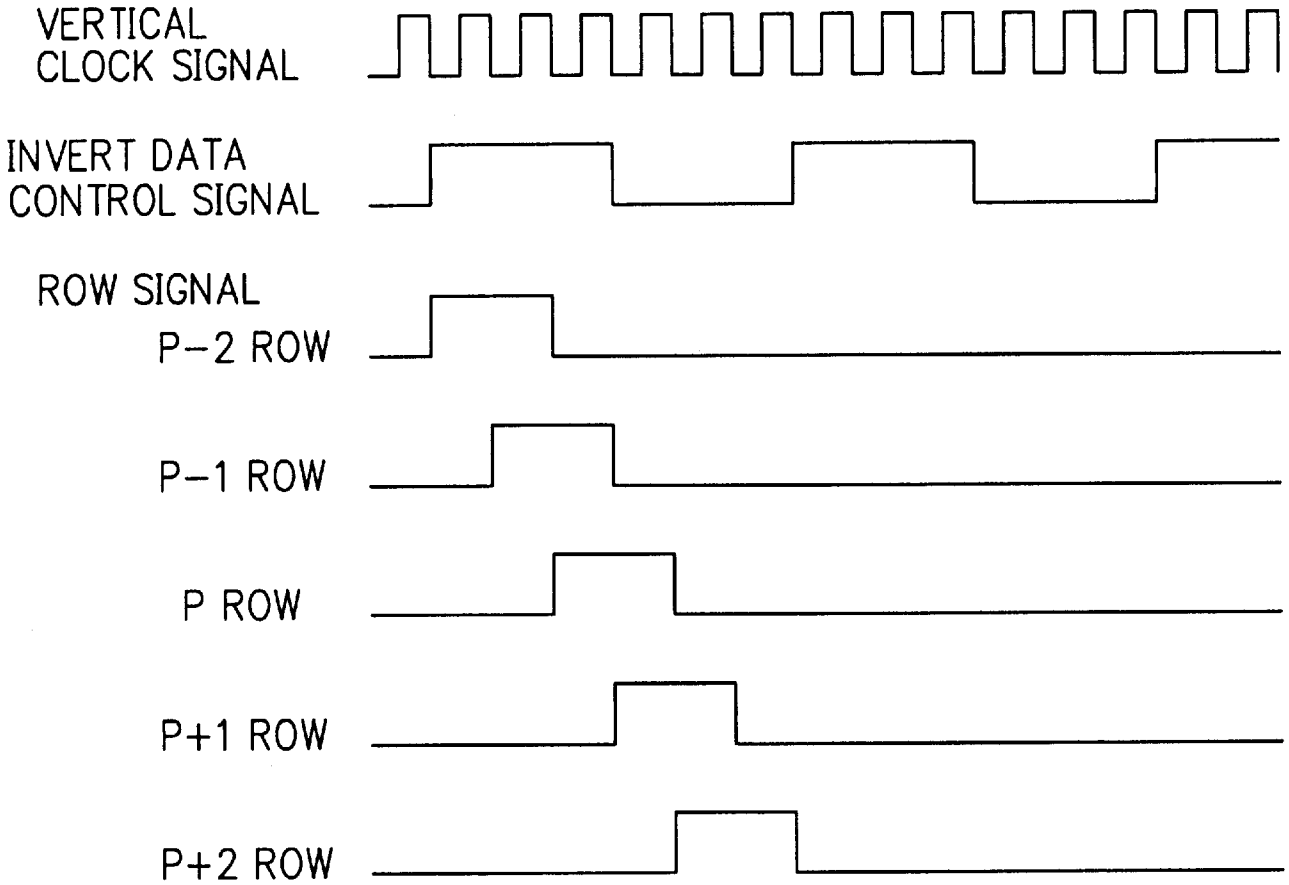
FIG. 7 is a timing chart for signals used in Embodiment 7 of the driving method of LCD apparatus of the present invention.

FIG. 7 is a timing chart showing signals to be used in Embodiment 7 of the method of driving the LCD apparatus of the present invention. On the paper face, the lateral direction shows time and the longitudinal direction shows the voltage value. From the top are shown a vertical clock signal controlling timing for changing the column signal for displaying a given image, an invert data control signal, and a row signal. Among the row signals, only a row signal to be applied to five row signals in the LCD apparatus is shown. From the top are shown a row signal (which shows "(p−2) row" in the drawing) to be applied to the (p−2)-th row signal line, and a row signal ("(p−1) row" in the drawing) to be applied upon the (p−1)-th row signal, a row signal ("p row" in the drawing) to be applied upon the p-th row signal, a row signal ("(p+l) row" in the drawing) to be applied upon the (P+1)-th row signal line, and a row signal ("(p+2) row" in the drawing) to be applied upon the (p+2)-th row signal line. Reference numeral p is 0 or a natural number.

Each time the vertical clock signal is switched to a low level from a high level, the predetermined row signal lines are sequentially selected. Column signals are applied through the column signal line to pixels including the TFT connected with the selected row signal line. Namely, in case one row signal line is selected, one row portion of pixels are selected. When two row signals are selected, two row portions of pixels are selected. Every time the vertical clock signal is switched from the high level to the low level, the predetermined row signal lines are sequentially selected. The same thing can be said to a case where the predetermined row signal lines are sequentially selected each time the vertical clock signal is switched from the low level to the high level, or the row signal lines are sequentially selected at the raise and fall edge of signal when the vertical clock signal is switched from the high level to the low level and from the low level to the high level. The predetermined row signal lines are sequentially selected on the boundary of the raise and fall edge of signal which becomes a control reference of the vertical clock signal.

Referring to FIG. 7, the (p−2)-th row signal is selected (although not shown, at least one row signal except for (p−2) row, (p−1) row, p row, (p+1) row and (p+2) row is switched to the high level), because the (p−2) row is switched to the high level in a timing (hereinafter referred to as "switching timing") where a first vertical clock signal from the left side is switched to the low level from the high level. Namely, in the first switching timing from the left side, one row portion of pixels in the (p−2)-th row signal line are selected. In the second switching timing from the left side, the (p−2) row is a high level successively and the (p−1) row is switched to the high level. Namely, in the second switching timing from the left side, two row portions of pixels in the (p−2)-th row signal line and the (p−1)-th row signal line are selected.

The polarity of the column signal to be applied upon the pixels are determined by the level of the invert data control signal. In the specification, the polarity of the column signal is to be positive when, for example, the invert data control signal is a high level. The positive polarity column signals are applied upon the pixels for constituting the row selected from the first switching time from the left side to the fourth switching timing from the left side. The negative column signals are applied upon the pixels for constituting the row selected from the fourth switching timing from the left side to the seventh switching timing from the left side.

A column signal to be applied upon the pixel in the other row signal lines to obtain the desired displaying can be applied even upon the pixel in the (p−2)-th row signal line from the first switching timing from the left side to the second switching timing from the left side. A column signal to obtain the desired displaying can be applied upon the pixel in the (p−2)-th row signal line from the second switching timing from the left side to the third switching timing from the left side. As the result, the pixel in the (p−2)-th row signal line can charge the column signal preliminarily from the first switching timing from the left side to the second switching timing from the left side. The driving method shown in FIG. 7 is performed by composing logic circuits in polarity control signal generating circuit.

According to the method of driving the LCD apparatus of Embodiment 7, the high picture quality less in flickers and cross talk can be displayed with lower power consumption and the charging time to the pixel become longer and higher picture quality can be displayed.

EMBODIMENT 8

Embodiment 8 of the method of driving the LCD apparatus of the present invention will be described with reference to the drawings.

Embodiment 8, in the raise and fall edge of signal which becomes the control reference of the vertical clock signal, is different from Embodiment 7 in that the column signals are not applied continuously upon the pixel in the same row signal line, but is the same as those of Embodiment 7 in the other respects.

Generally the shift register within the row driving circuit is controlled at the raise and fall edge of signal which becomes the control reference of the vertical clock signal, and the row signals are sequentially outputted and selected with respect to the row signals. The predetermined column signals of the pixel of the rows are outputted from the signal driving circuit in synchronous relation and are applied upon the pixels through the column signal line and the TFTs. At this time, when, for example, two row signal lines are selected at the same time, the original column signal is charged to the pixels in the next row signal line by the column signal for the signal line use of the previous line after the pixel in the next row signal line has been charged preliminarily, so as to obtain the higher picture quality, because the sufficient charging can be conducted to the pixel. At this time, the output of the signal driving circuit becomes sometimes unsteady once when the column signal is switched from the column signal for the previous row signal line use which becomes preliminary charging to the original column signal.

Figure 8:
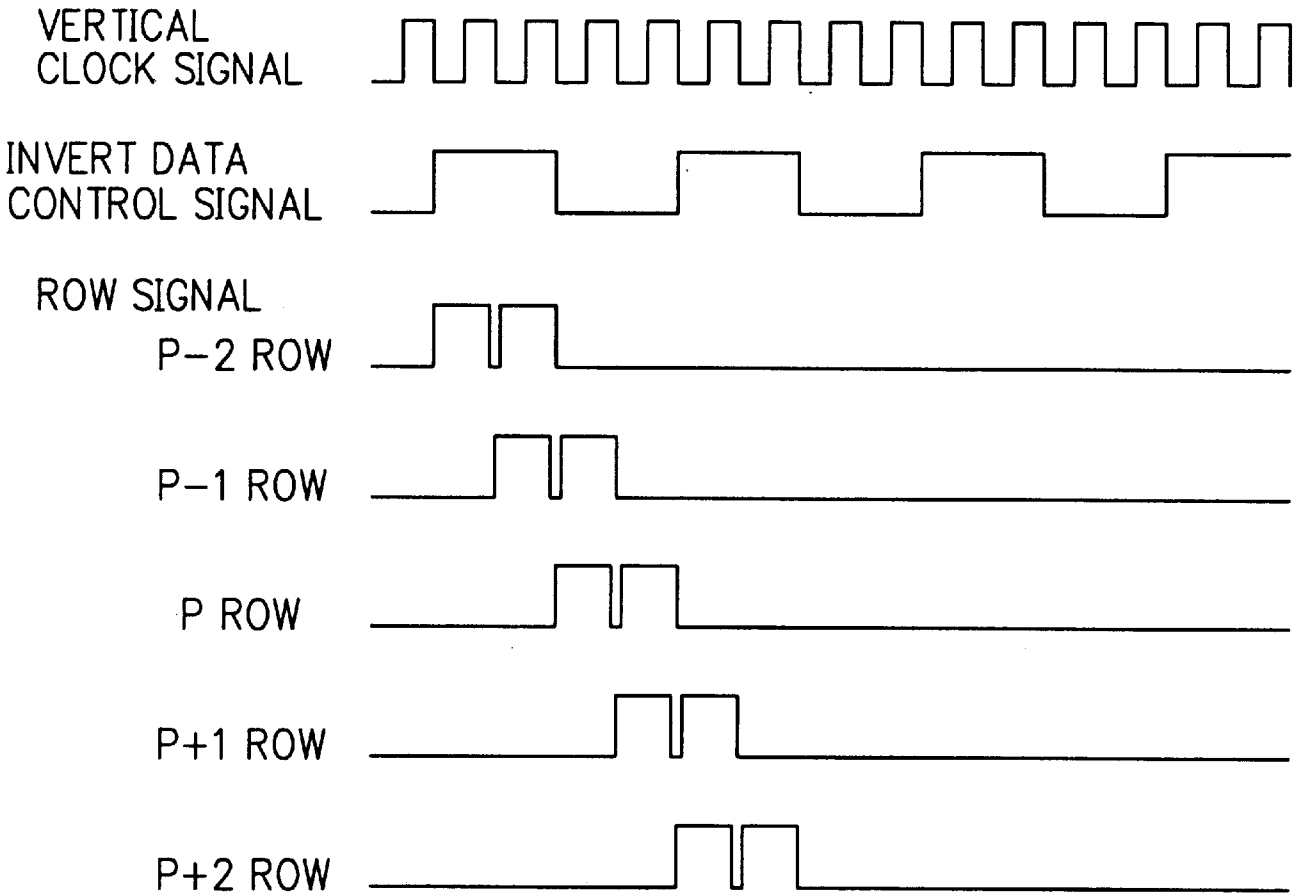
FIG. 8 is a timing chart for signals used in Embodiment 8 of the driving method of LCD apparatus of the present invention.

FIG. 8 is a timing chart showing a signal to be used in Embodiment 8 of the method of driving the LCD apparatus of the present invention. On the paper face, the lateral direction shows time and the longitudinal direction shows the voltage value. FIG. 8 shows, from the top, a vertical clock signal, an invert data control signal, (p−2) row, (p−1) row, p row, (p+1) row and (p+2) row.

As shown in FIG. 8, the (p−2) row is made a high level from the first switching timing from the left side to the third switching timing from the left, and the (p−2) row is made a low level in the second switching timing from the left side. As the result, when the vertical clock signal is switched from the high level to the low level, the column signal is not applied consectively upon the pixels when the output of the signal driving circuit becomes variable. The driving method shown in FIG. 8 is performed by composing logic circuits in polarity control signal generating circuit.

According to the method of driving the LCD apparatus of Embodiment 8, the high picture quality less in flickers and cross talk can be displayed with lower power consumption, and the charging time to the pixel becomes longer, so as to display the higher picture quality. Furthermore, the column signal of the voltage value of the predetermined magnitude and polarity can be applied to pixels.

EMBODIMENT 9

Embodiment 9 of the method of driving the LCD apparatus of the present invention will be described with reference to the drawings.

Embodiment 9 is different from Embodiment 8 in that the polarity of the column signal to be applied to pixels for conducting the preliminary charging operation is made always the same as that of the column signal to be applied upon the pixels for obtaining the desired displaying, but is the same as Embodiment 8 in the other respect points.

Figure 9:
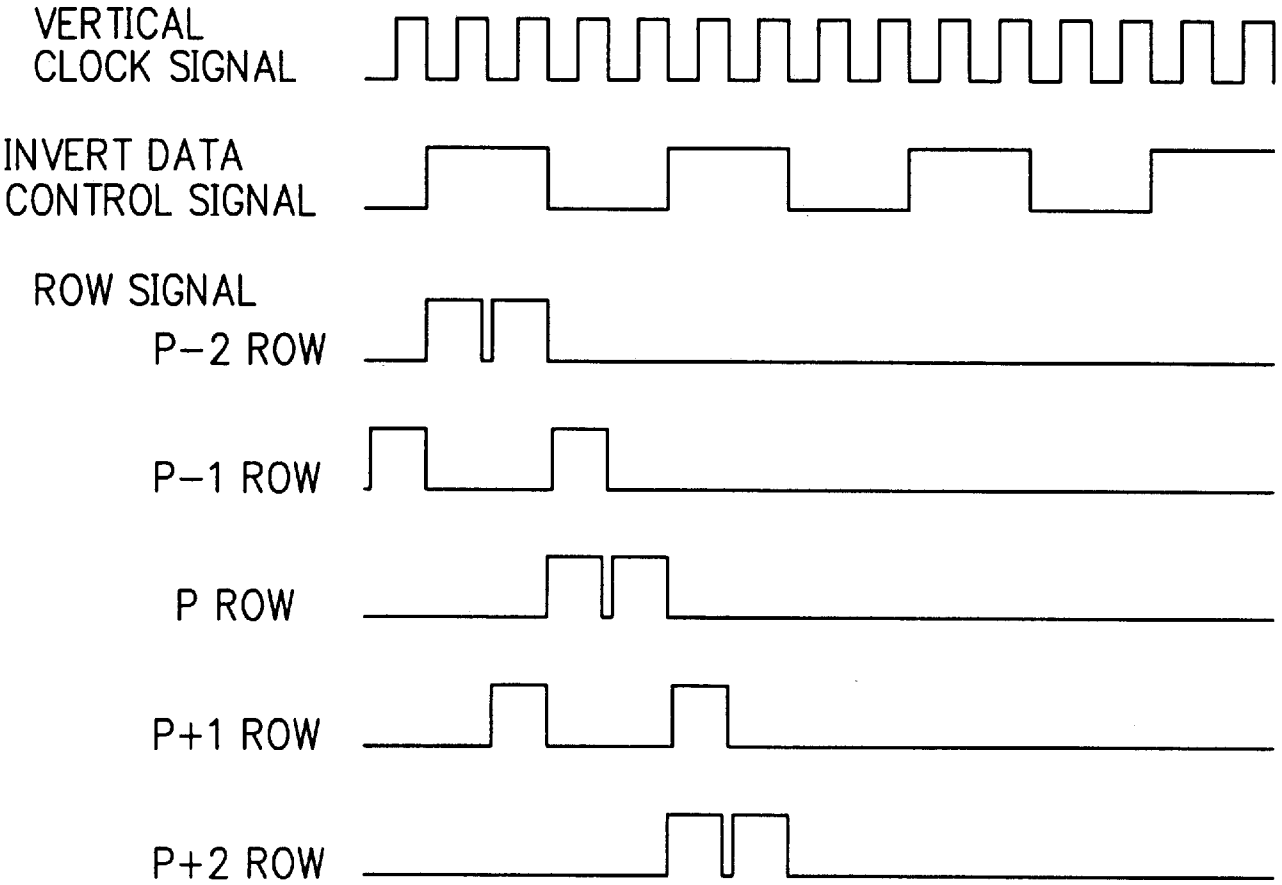
FIG. 9 is a timing chart for signals used in Embodiment 9 of the driving method of LCD apparatus of the present invention.

FIG. 9 is a timing chart showing signals to be used in Embodiment 9 of the method of driving the LCD apparatus of the present invention. On the paper face, the lateral direction shows time and the longitudinal direction shows the voltage value. FIG. 9 shows, from the top, a vertical clock signal, an invert data control signal, (p−2) row, (p−1) row, p row, (p+1) row and (p+2) row.

Referring to, for example, the (p+1) row, the preliminary charging is conducted from the second switching timing from the left side to the third switching timing from the left side. The polarity of the column signal to be applied when the preliminary charging operation becomes the same as that of the column signal to be applied from the fifth switching timing from the left side to the sixth switching timing from the left side for obtaining the predetermined image. The driving method shown in FIG. 9 is performed by composing logic circuits in polarity control signal generating circuit.

According to the method of driving the LCD apparatus of Embodiment 9, the high picture quality less in flickers and cross talk can be displayed with low power consumption, and the charging time to the pixels becomes longer and the higher picture quality can be displayed, thereby preventing the preliminary charging operation by the column signal of the reverse plurality, and inferior charging operation.

EMBODIMENT 10

Embodiment 10 of the method of driving the LCD apparatus of the present invention will be described with reference to the drawings.

Embodiment 10 is different from Embodiment 7 in that the preliminary charging operation is not conducted when the polarity of the column signal to be applied upon pixels for conducting the preliminary charging operation is different from that of the column signal to be applied to the pixels for obtaining the desired display, but is the same as Embodiment 7 in the other respects.

Figure 10:
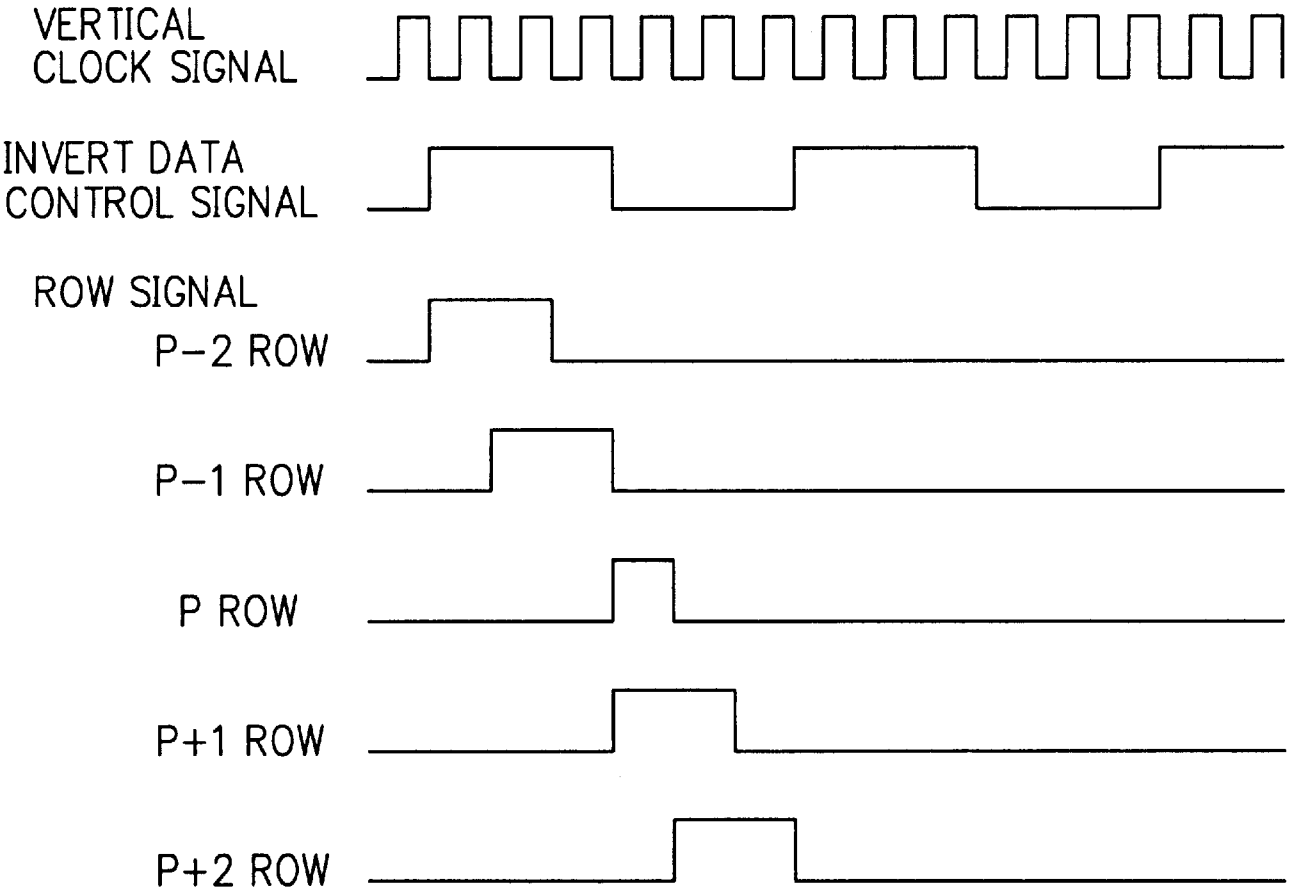
FIG. 10 is a timing chart for signals used in Embodiment 10 of the driving method of LCD apparatus of the present invention.

FIG. 10 is a timing chart showing signals to be used in Embodiment 10 of the method of driving the LCD apparatus of the present invention. On the paper face, the lateral direction shows time and the longitudinal direction shows the voltage value. FIG. 10 shows, from the top, a vertical clock signal, an invert data control signal, (p−2) row, (p−1) row, p row, (p+1) row and (p+2) row.

The p row is not in a high level from the third switching timing from the left side to the fourth switching timing from the left side. Namely, the preliminary charging operation is not conducted upon the pixels in the p-th row signal line. According to FIGS. 3(*a*) and 3(*b*), in the (m+1) frame, the column signal of the polarity the same as that of the (m+1) frame even in the m frame is applied upon the pixel different from one upper pixel in polarity, for example, the fourth pixel from the top. Thus, in the (m+1) frame, the preliminary charging operation is not required. The driving method shown in FIG. 10 is performed by composing logic circuits in polarity control signal generating circuit.

According to the method of driving the LCD apparatus of Embodiment 10, the high picture quality less in flickers and cross talk can be displayed with low power consumption, and the charging time to the pixels becomes longer and the higher picture quality can be displayed, thereby preventing the preliminary charging operation by the column signal of the reverse polarity, and inferior charging operation.

Applying the column signal of the same polarity as that of the previous frame upon the pixel where the preliminary charging operating is not conducted is preferable, because the column signal can be sufficiently charged upon all the pixels.

EMBODIMENT 11

In the above described Embodiments 1 through 10, in the column direction, a plurality of pixels are divided into a plurality of groups each composed of at least two pixels. In the row direction, a plurality of pixels can be divided into a plurality of groups each composed of at least two pixels so that the polarity of the picture signal can be changed for each group. Furthermore, in the column direction and the row direction, a plurality of pixels can be divided into a plurality of groups each composed of at least two pixels so that the polarity of the column signal can be changed for each group. In the column direction and/or the row direction, a controlling circuit for making the polarity of the column signal the predetermined polarity has only to provide in the signal driving circuit to divide a plurality of pixels into a plurality of groups each composed of at least two pixels.

EMBODIMENT 12

Figure 11:
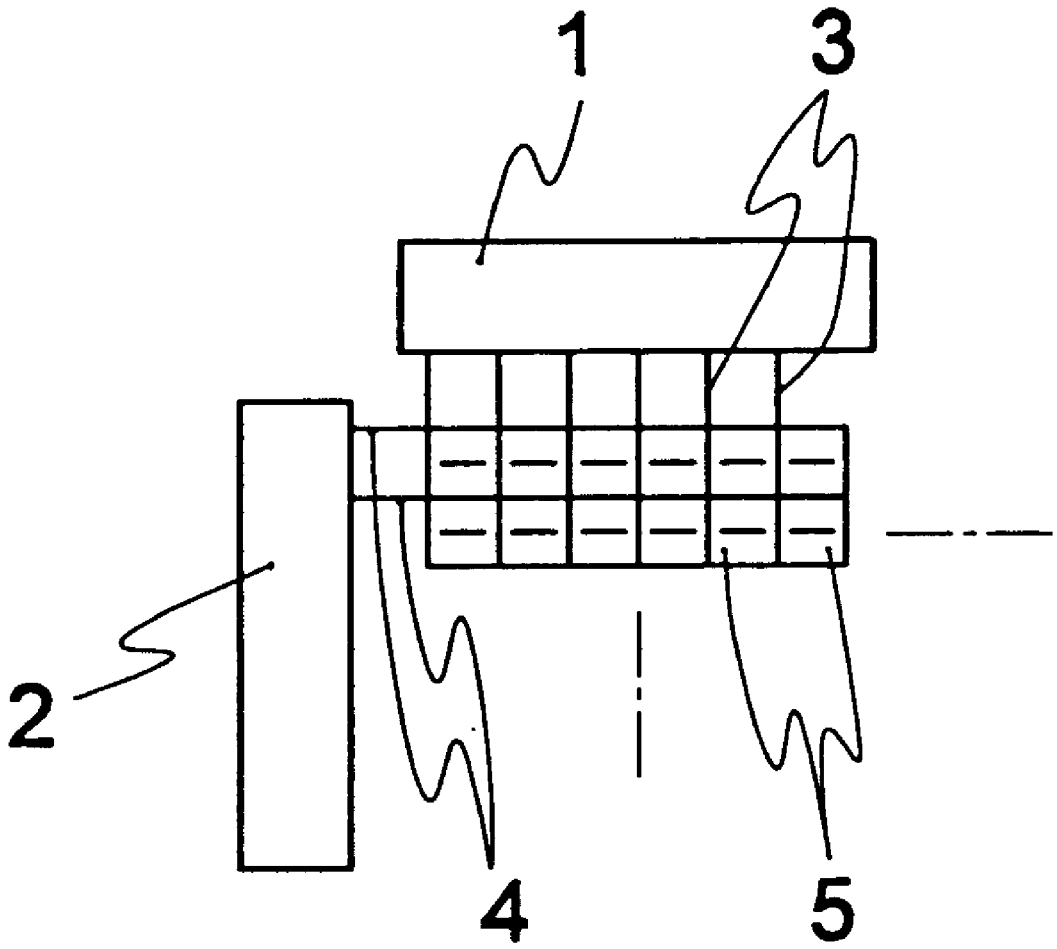
FIG. 11 is an explanatory drawing for illustrating an example of LCD apparatus and Embodiment 12 of the driving method of LCD apparatus of the present invention.
Figure 12A:
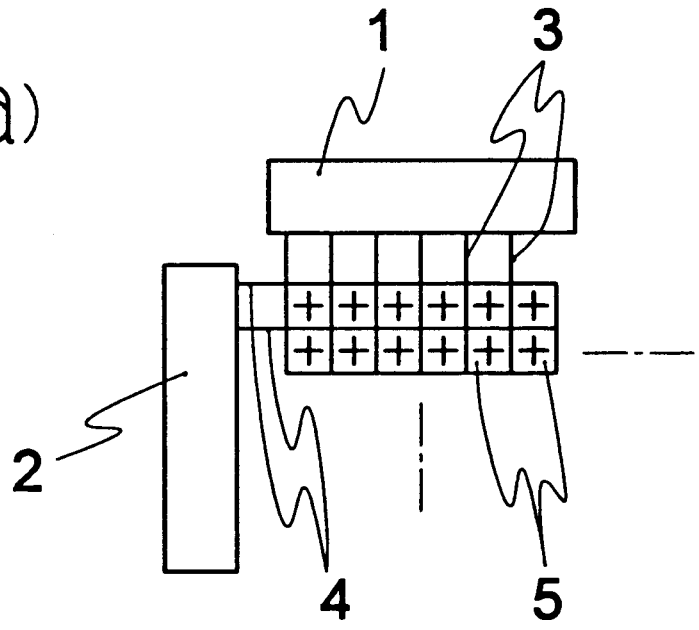
FIGS. 12(*a*) and 12(*b*) are explanatory drawings for illustrating an example of LCD apparatus and Embodiment 12 of the driving method of LCD apparatus of the present invention.
Figure 12B:
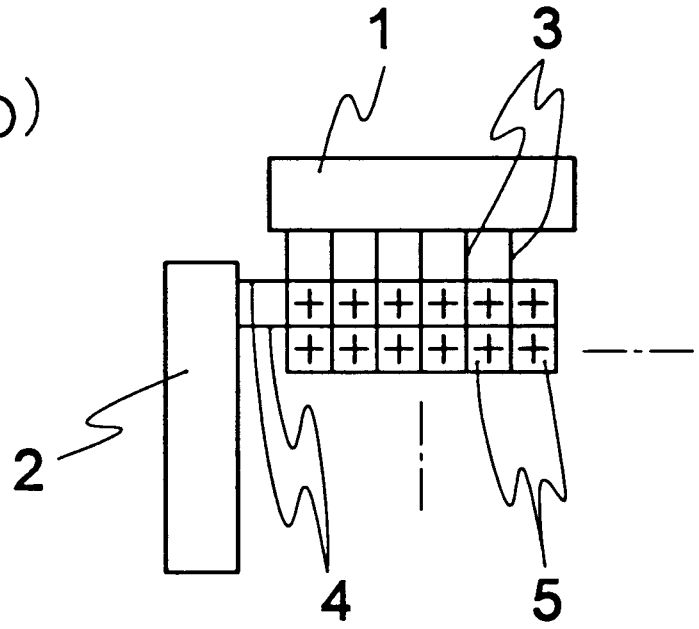
Figure 13A:
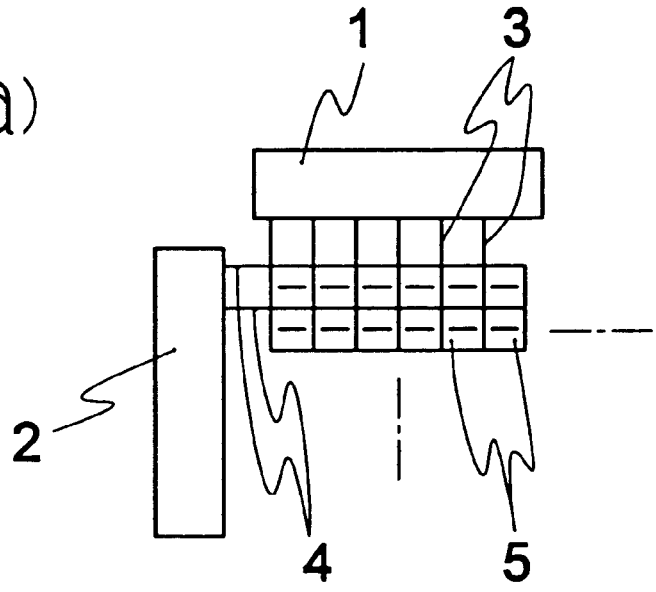
FIGS. 13(*a*) and 13(*b*) are explanatory drawings for illustrating an example of LCD apparatus and Embodiment 12 of the driving method of LCD apparatus of the present invention.
Figure 13B:
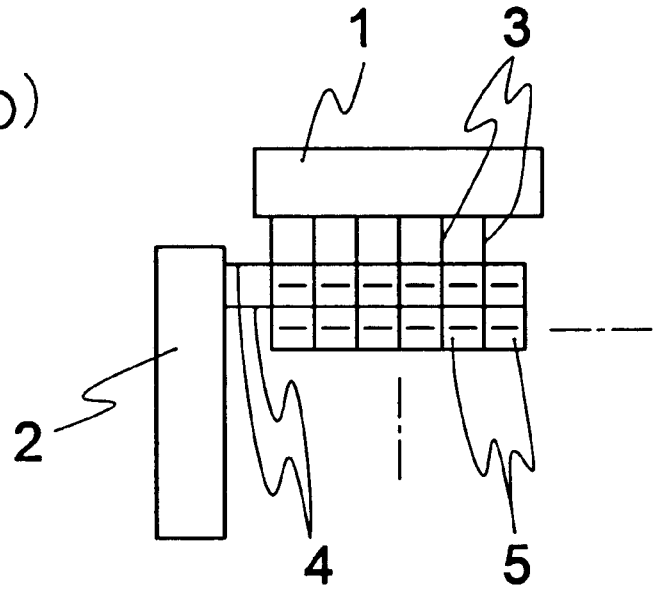

FIGS. 11, 12(*a*), 12(*b*), 13(*a*) and 13(*b*) are illustrating views showing one example of the LCD apparatus of the present invention. Reference numerals shown in the drawings are common in FIGS. 1 through 10. For easier illustration, only 6×2 pixels are shown and polarity control signal generating circuit is not shown. FIG. 11 shows the polarity of the column signal to be applied to pixels of the LCD apparatus in a certain frame (m frame). As shown in FIGS. 12(*a*) and 12(*b*), in the set of the k frame from the (m+1) frame to the (m+k) frame, the polarity of the column signal to be applied upon all the pixels sequentially from left in the first and second from the top is positive. As shown in FIGS. 13(*a*) and 13(*b*), in the set of the k frame from the (m+k+1) frame to the (m+2k) frame, the polarities of the column signal to be applied upon all the pixels sequentially from the left in the first and second from the top are negative. In the third and its subsequent from the top, the polarity can be made the same as those of the first and second rows, or opposite polarity. According to the driving method shown in Embodiments 1 through 10, the polarity of pixels can be determined.

The number of k is a natural number which does not exceed m. The k can be made constant or variable. In case of changing, the k can be changed based on a constant rule, or changed irregularly.

In this manner, a plurality of k frames are collectively set to classify plural pixels into a plurality of sets, and the polarity of the column signal to be applied upon the pixels is changed for each set so that the signal of the same polarity can be applied across a plurality of k frames to the same pixels. Thus, the charging time can be made longer and the higher picture quality can be displayed.

Figure 14:
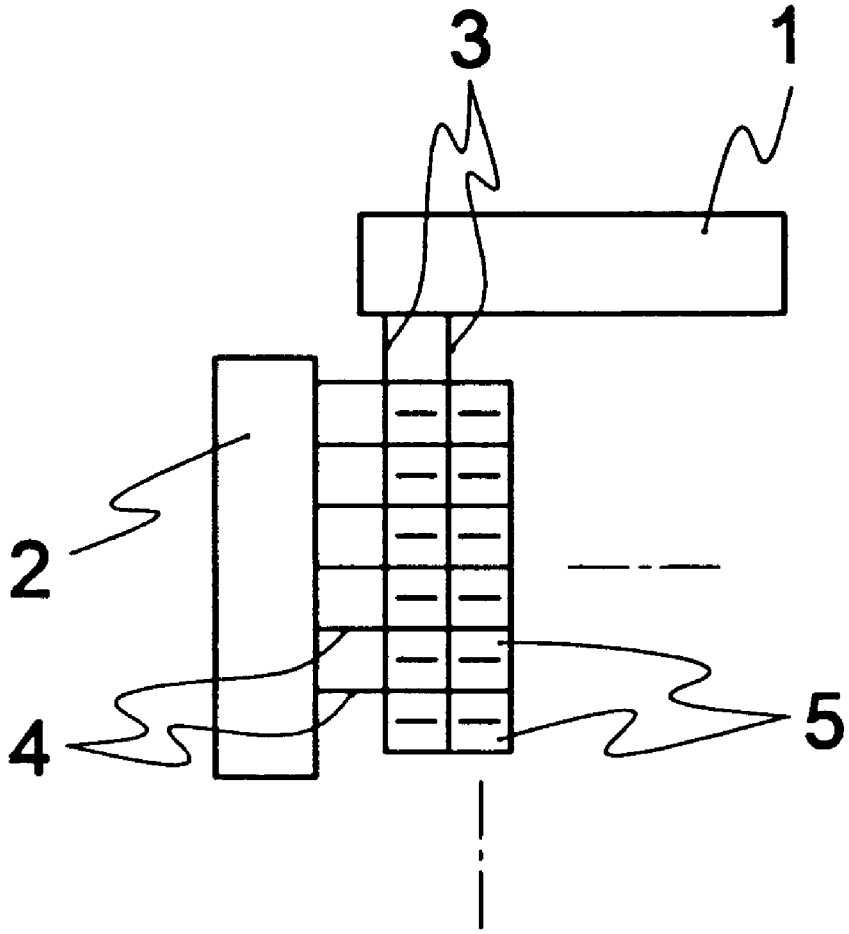
FIG. 14 is an explanatory drawing for illustrating an example of LCD apparatus and Embodiment 12 of the driving method of LCD apparatus of the present invention.
Figure 15A:
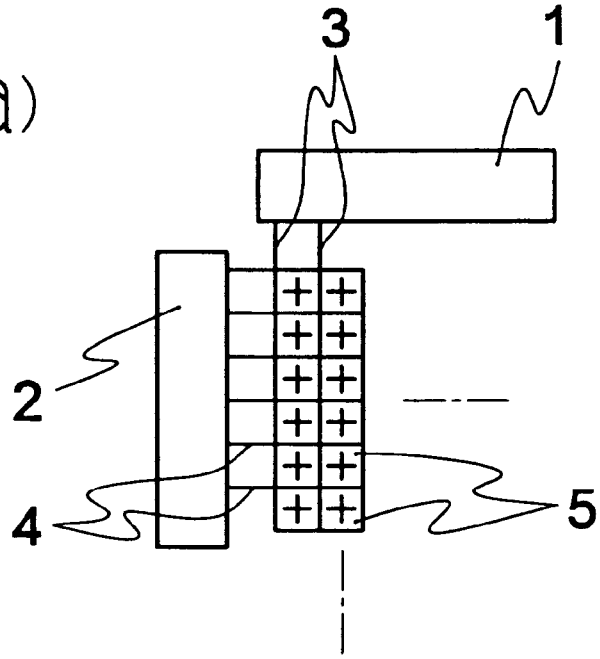
FIGS. 15(*a*) and 15(*b*) are explanatory drawings for illustrating an example of LCD apparatus and Embodiment 12 of the driving method of LCD apparatus of the present invention.
Figure 15B:
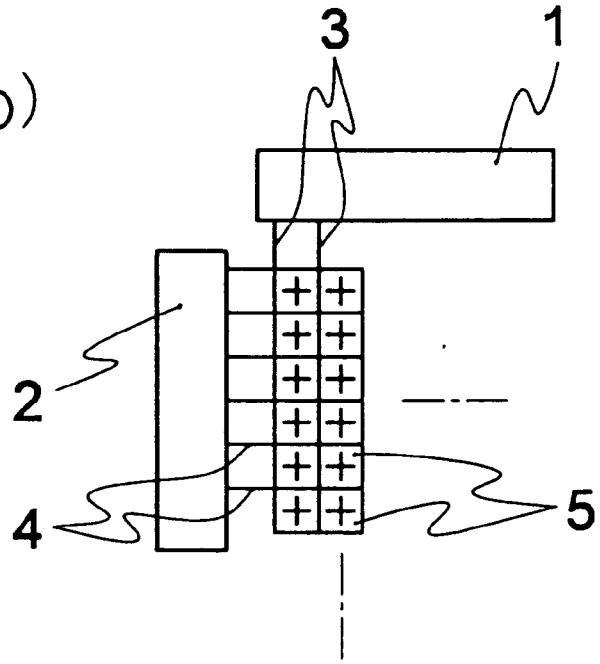
Figure 16A:
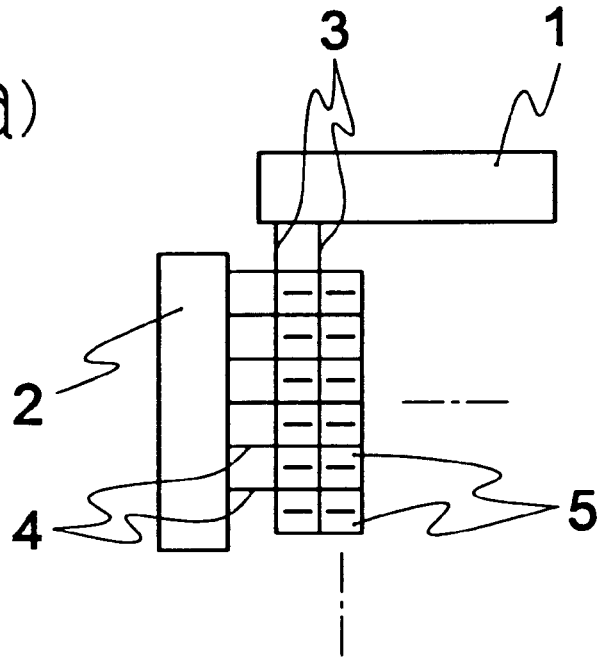
FIGS. 16(*a*) and 16(*b*) are explanatory drawings for illustrating an example of LCD apparatus and Embodiment 12 of the driving method of LCD apparatus of the present invention.
Figure 16B:
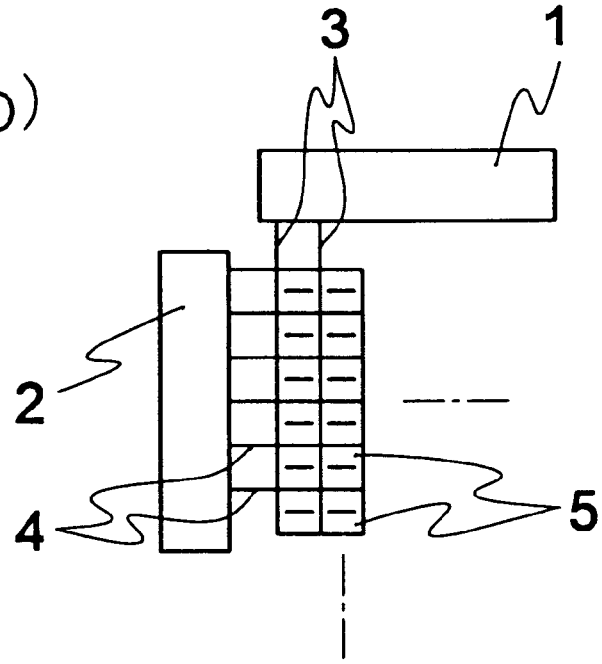

FIGS. 14, 15(*a*), 15(*b*), 16(*a*) and 16(*b*) are illustrating views each showing another example of the LCD apparatus of the present embodiment. Reference numerals in the drawings are common in FIGS. 1 through 10. FIG. 14 shows the polarity of the column signal to be applied upon pixels of the LCD apparatus in a certain frame (m frame). As shown in FIGS. 15(*a*) and 15(*b*), in the set of the k frame from the (m+1) frame to the (m+k) frame, the polarity of the column signal to be applied upon all the pixels sequentially from left in the first and second from the top is positive. As shown in FIGS. 16(*a*) and 16(*b*), in the set of the k frame from the (m+k+1) frame to the (m+2k) frame, the polarities of the column signal to be applied upon all the pixels sequentially from the top in the first and second from the left are negative.

In this manner, a plurality of k frames are collectively set to classify plural pixels into a plurality of sets, and the polarity of the column signal to be applied upon the pixels is changed for each set so that the signal of the same polarity can be applied across a plurality of k frames upon the same pixel. Thus, the charging time can be made longer and the higher picture quality can be displayed.

Figure 17:
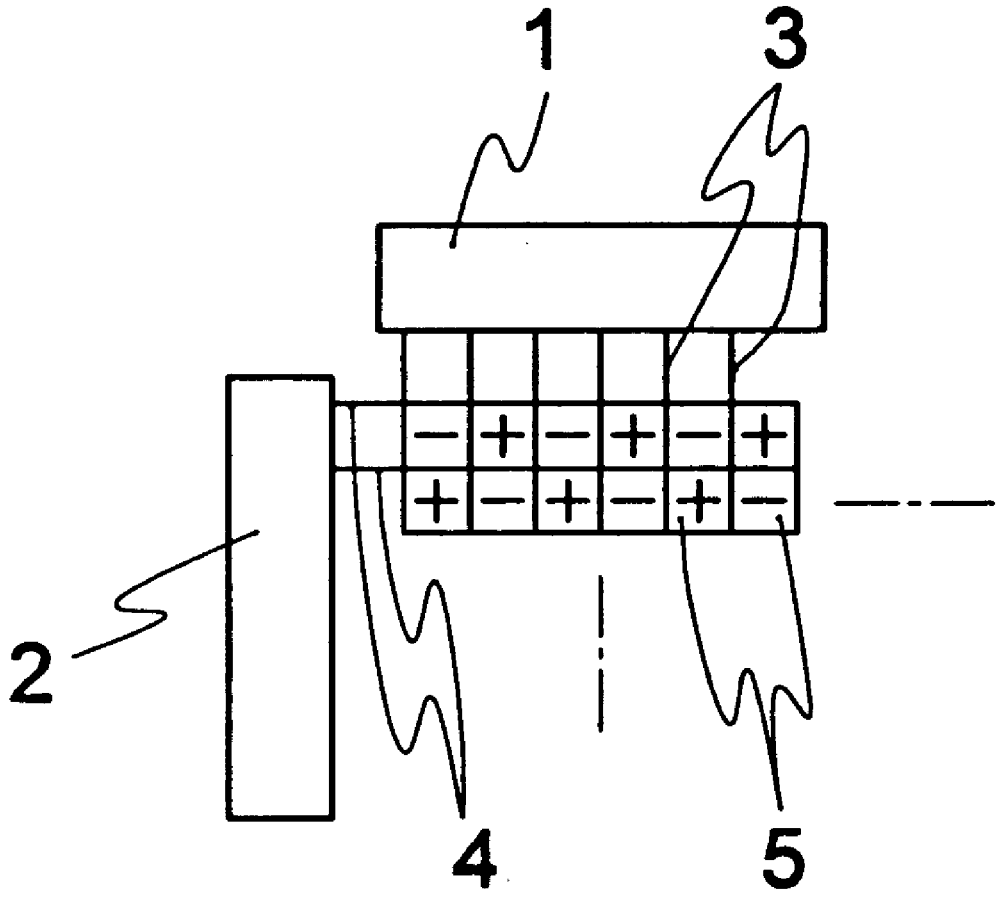
FIG. 17 is an explanatory drawing for illustrating an example of LCD apparatus and Embodiment 12 of the driving method of LCD apparatus of the present invention.
Figure 18A:
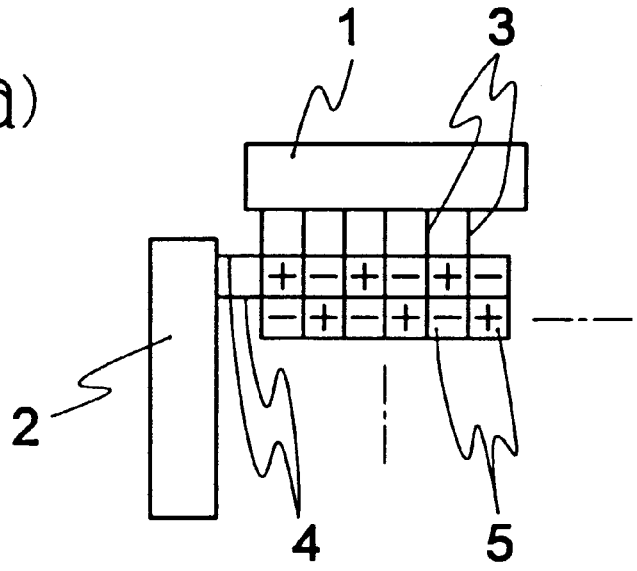
FIGS. 18(*a*) and 18(*b*) are explanatory drawings for illustrating an example of LCD apparatus and Embodiment 12 of the driving method of LCD apparatus of the present invention.
Figure 18B:
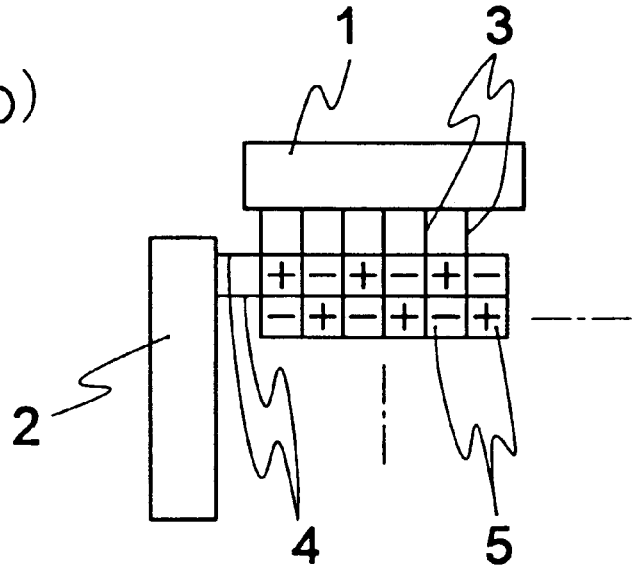
Figure 19A:
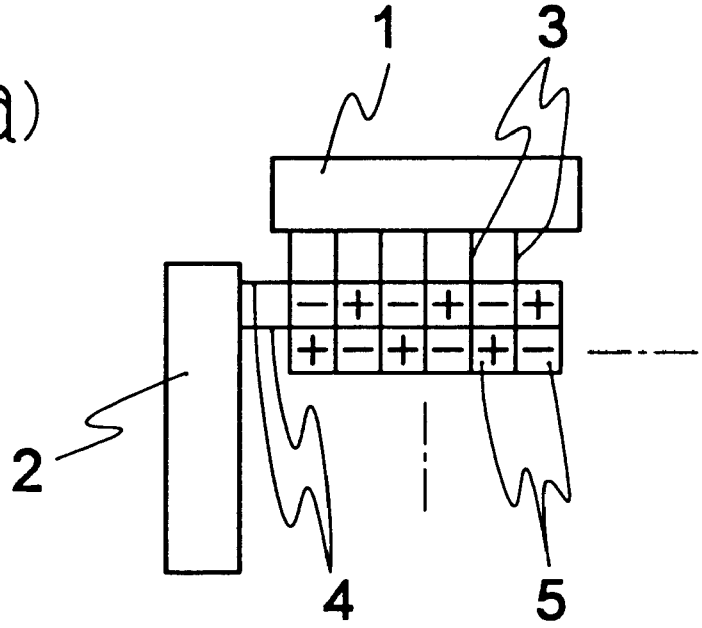
FIGS. 19(*a*) and 19(*b*) are explanatory drawings for illustrating an example of LCD apparatus and Embodiment 12 of the driving method of LCD apparatus of the present invention.
Figure 19B:
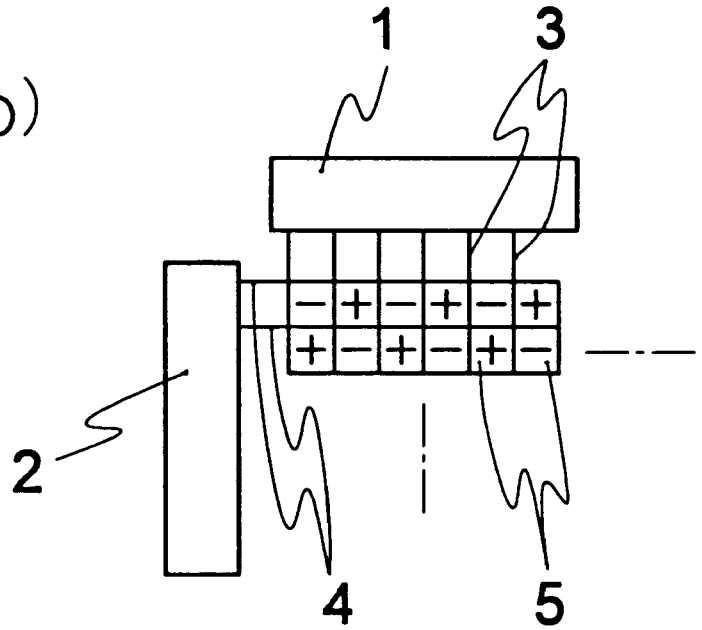

FIGS. 17, 18(*a*), 18(*b*), 19(*a*), and 19(*b*) are illustrating views each showing a further different example of the LCD apparatus of the present embodiment. Reference numerals in the drawings are common in FIGS. 1 through 10. FIG. 17 shows the polarity of the column signal to be applied upon the pixels of the LCD apparatus in a certain (m frame). As shown in FIGS. 18(*a*) and 18(*b*), in the set of the k frames from the (m+1) frame to the (m+k) frame, the polarity of the column signal to be applied upon all the pixels sequentially from left in the first row from the top is alternated like positive, negative, positive, and negative. In the second row from the top, the polarity of the column signal to be applied upon the pixels is alternated like negative, positive, negative and positive. As shown in FIGS. 19(*a*) and 19(*b*), in the set of the k frame from the (m+k+1) frame to the (m+2k) frame, the polarity opposite to that shown in FIGS. 18(*a*) and 18(*b*) are applied.

In this manner, a plurality of k frames are collectively set to classify plural pixels into a plurality of sets, to either of the driving method illustrated in Embodiments 1 through 11 so that the polarity of the column signal to be applied upon the pixels for each set is changed for each set. The signal of the same polarity can be applied across a plurality of frames upon the same pixel. Thus, the charging time can be made longer and the higher picture quality can be displayed.

The control of the polarity change in the column signal between such a plurality of frames can be realized by adding a controlling circuit in which logic circuits for operating by a frame are added in the polarity control signal generating circuit to the signal driving circuit 1 or the row driving circuit 2. Further, a timing controller for adjusting polarity of column signal or row signal is provided in the signal driving circuit 1 and in row driving circuit 2. The control of the polarity change can be realized also by adding a function for controlling the polarity change of the column signal the timing controller, for example by incorporating logic circuits for representing optional polarity.

A method of driving a LCD apparatus according to present invention is to display the predetermined images by applying the predetermined column signals upon the pixels for constituting the selected rows, of a plurality of pixels arranged in rows and columns, where a plurality of pixels are divided into a plurality of groups each composed of at least two pixels in the column direction, so as to change the polarity of the column signal for each group, thereby displaying the high picture quality less in flickers and cross talk with low power consumption.

A method of driving the LCD apparatus according to the present invention is to change for each frame the pixels composing each group, thereby displaying the high picture quality less in flickers and cross talk with low power consumption.

In a method of driving the LCD apparatus according to the present invention, one group is composed of n pixels and the boundary portion between the groups is shifted by (n−1) pixels for each frame, thereby reducing the flickers and displaying the high picture quality less in flickers and cross talk with low power consumption.

A method of driving the LCD apparatus according to the present invention is to change for each group the number of the pixels for constituting one group, thereby reducing the flickers and displaying the high picture quality less in flickers and cross talk with low power consumption.

A method of driving the LCD apparatus according to the present invention is to change regularly the number of the pixels for constituting the one group, thereby reducing the flickers and displaying the high picture quality less in flickers and cross talk with low power consumption.

A method of driving the LCD apparatus according to the present invention is to change irregularly the number of the pixels for constituting the one group, thereby reducing the flickers sharply and displaying the high picture quality less in flickers and cross talk with low power consumption.

A method of driving the LCD apparatus according to the present invention is to restrict the number of the pixels for composing the one group, thereby reducing the flickers sharply, displaying the high picture quality less in flickers and cross talk with low power consumption and further, preventing the liquid crystal from being deteriorated which is caused when the signals of the same polarity have been applied upon the pixels for long hours.

A method of driving the LCD apparatus according to the present invention is to have at least two in number of rows for selecting at the same time, thereby displaying the high picture quality less in flickers and cross talk with low power consumption so that the charging time to the pixels becomes longer and the higher picture quality can be displayed.

A method of driving the LCD apparatus according to the present invention is not to apply a row signal for controlling a selecting row upon the row, when the polarity of the vertical clock signal changes, in case the same row is selected before and after the raise and fall edge of signal which becomes a control reference of the vertical clock signal for controlling the timing for changing the column signal, thereby displaying the high picture quality less in flickers and cross talk with low power consumption so that the charging time to the pixels becomes longer and the higher picture quality can be displayed, and the column signals of the voltage value of the predetermined size and polarity can be added to the pixels.

A method of driving the LCD apparatus according to the present invention is to have the same polarity of the pixel for constituting a row for selecting at the same time in the column direction, thereby displaying the high picture quality less in flickers and cross talk with low power consumption so that the charging time to the pixels becomes longer and the higher picture quality can be displayed, and an insufficient charging operation, caused by charging the column signals different in polarity, can be reduced.

A method of driving the LCD apparatus according to the present invention is to have the same polarity, in the column direction, of the pixel for composing a row selected at the same time with the number of the rows to be selected at the same time being at least one, thereby displaying the high picture quality less in flickers and cross talk with low power consumption and the insufficient charging operation, caused by charging the column signals different in polarity, can be reduced.

A method of driving the LCD apparatus according to the present invention is to display the predetermined images by applying the predetermined column signals upon the pixels for constituting the selected row, of a plurality of pixels arranged in rows and columns, where a plurality of pixels are divided into a plurality of groups each composed of at least two pixels in the row direction, so as to change the polarity of the column signal for each group, thereby displaying the high picture quality less in flickers and cross talk with low power consumption.

A method of driving a LCD apparatus of the present invention is to display the predetermined images by applying the predetermined column signals upon the pixels for constituting the selected row, of a plurality of pixels arranged in rows and columns, where a plurality of pixels are divided into a plurality of groups each composed of at least two pixels in the column direction and the row direction, so as to change the polarity of the column signal for each group, thereby displaying the high picture quality less in flickers and cross talk with low power consumption.

A method of driving the LCD apparatus of the present invention is to display the predetermined images by applying the predetermined column signal upon the pixel for constituting the selected row, of a plurality of pixels arranged in rows and columns, where a plurality of frames are set collectively to classify plural pixels into a plurality of sets in the column direction, so as to change the polarity of the column signal for each set, thereby displaying the high picture quality so that the charging time to pixels becomes longer.

A method of driving the LCD apparatus of the present invention is to have at least two in number of rows for selecting at the same time, thereby displaying the high picture quality less in flickers and cross talk with low power consumption.

In a method of driving the LCD apparatus of the present invention, a row signal for controlling a selecting row upon the row is not applied, when the polarity of the vertical clock signal changes, in case the same row is selected before and after the raise and fall edge of signal which becomes a control reference of the vertical clock signal for controlling the timing for changing the column signal, thereby displaying the high picture quality less in flickers and cross talk with low power consumption so that the charging time to the pixels becomes longer and the higher picture quality can be displayed, and the column signals of the voltage value of the predetermined size and polarity can be added to the pixels.

A method of driving the LCD apparatus of the present invention is to have the same polarity of the pixel for composing a row for selecting at the same time in the column direction, thereby displaying the high picture quality less in flickers and cross talk with low power consumption so that the charging time to the pixels becomes longer and the higher picture quality can be displayed, and an insufficient charging operation, caused by charging the column signals different in polarity, can be reduced.

A method of driving the LCD apparatus of the present invention is to have the same polarity, in the column direction, of the pixel for constituting a row selected at the same time with the number of the rows to be selected at the same time being at least one, thereby displaying the high picture quality less in flickers and cross talk with low power consumption and the insufficient charging operation, caused by charging the column signals different in polarity, can be reduced.

A method of driving the LCD apparatus of the present invention is to change regularly the number of the frames for constituting the set, thereby displaying the high picture quality, so that the charging time to pixels becomes longer.

A method of driving the LCD apparatus of the present invention is to change irregularly the number of the frames for constituting the set, thereby displaying the high picture quality, so that the charging time to pixels becomes longer.

A method of driving the LCD apparatus of the present invention is to display the predetermined images by applying the predetermined column signal upon the pixel for composing the selected row, of a plurality of pixels arranged in rows and columns, where a plurality of frames are set collectively to classify plural pixels into a plurality of sets in the row direction, so as to change the polarity of the column signal for each set, thereby displaying the high picture quality, so that the charging time to pixels becomes longer.

A method of driving the LCD apparatus of the present invention is to have at least two in number of rows for selecting at the same time, thereby displaying the high picture quality less in flickers and cross talk with low power consumption so that the charging time to the pixels becomes longer and the higher picture quality can be displayed.

In a method of driving the LCD apparatus of the present invention, a row signal for controlling a selecting row upon the row is not applied, when the polarity of the vertical clock signal changes, in case the same row is selected before and after the raise and fall edge of signal which becomes a control reference of the vertical clock signal for controlling the timing for changing the column signal, thereby displaying the high picture quality less in flickers and cross talk with low power consumption so that the charging time to the pixels becomes longer and the higher picture quality can be displayed, and the column signals of the voltage value of the predetermined size and polarity can be added to the pixels.

A method of driving the LCD apparatus of the present invention is to have the same polarity of the pixel for constituting a row for selecting at the same time in the column direction, thereby displaying the high picture quality less in flickers and cross talk with low power consumption so that the charging time to the pixels becomes longer and the higher picture quality can be displayed, and an insufficient charging operation, caused by charging the column signals different in polarity, can be reduced.

A method of driving the LCD apparatus described of the present invention is to have the same polarity, in the column direction, of the pixel for constituting a row selected at the same time with the number of the rows to be selected at the same time being at least one, thereby displaying the high picture quality less in flickers and cross talk with low power consumption and the insufficient charging operation, caused by charging the column signals different in polarity, can be reduced.

A method of driving the LCD apparatus of the present invention is to change regularly the number of the frames for constituting the set, thereby displaying the high picture quality so that the charging time to pixels becomes longer.

A method of driving the LCD apparatus of the present invention is to change irregularly the number of the frames for constituting the set, thereby displaying the high picture quality so that the charging time to pixels becomes longer.

It should be understood that the apparatus and methods which have been shown and described herein are illustrative of the invention and are not intended to be limitative thereof. Clearly, those skilled in the art may conceive of variations or modifications to the invention. However, any such variations or modifications which falls within the purview of this description are intended to be included therein as well. The scope of the invention is limited only by the claims appended hereto.

What is claimed is:

1. A method for driving an LCD apparatus in which a series of image frames are displayed by applying predetermined column signals to each column of aligned pixels formed as an array of pixels having further pixel alignment in a row direction across said columns to form rows of pixels and selecting at least one of said rows while said column signals are being applied during each frame, comprising:

forming groups by dividing the pixels in the columns into said groups so that each formed group has at least two adjacent pixels in a direction of the columns;

applying said column signals to each adjacent group in the column direction with a different polarity during each frame; and changing an arrangement of at least some of the groups during different image frames, wherein said arrangement being changed includes changing at least some of the pixels forming at least some of the groups.

2. The method for driving an LCD apparatus of claim 1, wherein the changing of the number of said pixels for forming at least some of the groups is done regularly.

3. The method for driving an LCD apparatus of claim 1, wherein the changing of the number of said pixels for forming at least some of the groups is done irregularly.

4. The method for driving an LCD apparatus of claim 5, wherein the number of said pixels that can be formed into any group is restricted.

5. A method for driving an LCD apparatus in which a series of image frames are displayed by applying predetermined column signals to each column of aligned pixels formed as an array of pixels having further pixel alignment in a row direction across said columns to form rows of pixels and selecting at least one of said rows while said column signals are being applied during each frame, comprising:

forming groups by dividing the pixels in the columns into said groups so that each formed group has at least two adjacent pixels in a direction of the columns; and applying said column signals to each adjacent group in the column direction with a different polarity during each frame, wherein a number of rows for selecting at the same time is at least two and a row signal for controlling a row selection is not applied when polarity of a vertical clock signal changes and the same row is selected before and after a rise or fall of an edge of a signal which becomes a control reference of said vertical clock signal controlling a timing for changing said column signals.

6. A method for driving an LCD apparatus in which a series of image frames are displayed by applying predetermined column signals to each column of aligned pixels formed as an array of pixels having further pixel alignment in a row direction across said columns to form rows of pixels and selecting at least one of said rows while said column signals are being applied during each frame, comprising:

forming groups by dividing the pixels in the columns into said groups so that each formed group has at least two adjacent pixels in a direction of the columns; and applying said column signals to each adjacent group in the column direction with a different polarity during each frame, wherein a number of rows for selecting at the same time is at least two and for a selected row, a preliminary charging of a pixel is made when a polarity of the column signal is the same as a polarity when a consecutive charging is made.

7. A method for driving an LCD apparatus in which a series of image frames are displayed by applying predetermined column signals to each column of aligned pixels formed as an array of pixels having further pixel alignment in a row direction across said columns to form rows of pixels and selecting at least one of said rows while said column signals are being applied during each frame, comprising:

forming groups by dividing the pixels in the columns into said groups so that each formed group has at least two adjacent pixels in a direction of the columns; and applying said column signals to each adjacent group in the column direction with a different polarity during each frame, wherein a number of rows for selecting at the same time is at least two and charging of a pixel is made so that, for a selected row having a charging period bridging a polarity change of the column signal, a charging in a time period is omitted when a polarity of the column signal is opposite to a polarity of the column signal of a previous frame.

* * * * *